US010870522B2

(12) United States Patent
Lane

(10) Patent No.: US 10,870,522 B2
(45) Date of Patent: Dec. 22, 2020

(54) LID WITH ACTUATOR FOR VALVE ASSEMBLY

(71) Applicant: THERMOS L.L.C., Schaumburg, IL (US)

(72) Inventor: Marvin Lane, Wheeling, IL (US)

(73) Assignee: THERMOS L.L.C., Schaumburg, IL (US)

( * ) Notice: Subject to any disclaimer, the term of this patent is extended or adjusted under 35 U.S.C. 154(b) by 0 days.

(21) Appl. No.: 16/544,085

(22) Filed: Aug. 19, 2019

(65) Prior Publication Data

US 2020/0055645 A1 Feb. 20, 2020

Related U.S. Application Data

(60) Provisional application No. 62/720,018, filed on Aug. 20, 2018.

(51) Int. Cl.
*B65D 47/24* (2006.01)
*B65D 47/28* (2006.01)

(52) U.S. Cl.
CPC ..... *B65D 47/243* (2013.01); *B65D 47/286* (2013.01); *B65D 2251/06* (2013.01); *B65D 2251/20* (2013.01)

(58) Field of Classification Search
CPC ..... B65D 47/286; B65D 47/248; B65D 47/243–245; B65D 2543/00092; B65D 2543/00046; B65D 2543/00972; B65D 2543/00518; B65D 2547/063; B65D 2251/20; B65D 2251/06; B65D 2251/0025; B65D 2251/0087; B65D 51/18; B65D 51/247; A47G 19/2272
USPC ..... 222/153.01, 153.11–153.14, 510–514, 222/505, 518, 509; 220/714, 715, 303, 220/317, 323
See application file for complete search history.

(56) References Cited

U.S. PATENT DOCUMENTS

| | | | | |
|---|---|---|---|---|
| 5,615,808 | A * | 4/1997 | Huang | A47J 41/00 222/472 |
| 6,116,476 | A * | 9/2000 | Huang | B65D 47/249 222/506 |
| 9,375,107 | B2 * | 6/2016 | Gilbert | A47G 19/2272 |
| 9,873,554 | B2 * | 1/2018 | Choltco-Devlin | A47G 19/2272 |
| 2010/0206835 | A1 * | 8/2010 | Yu | A47J 41/0027 215/355 |

* cited by examiner

*Primary Examiner* — Lien M Ngo
(74) *Attorney, Agent, or Firm* — Polsinelli PC

(57) ABSTRACT

A lid is described to reduce spillage or leakage of fluids contained in a beverage container. The lid includes the actuator that opens and closes a dispensing opening of the lid and also opens and closes a valve of the lid to reduce spillage or leakage from the beverage container. As the actuator is opened, the dispensing opening is uncovered and the valve opened.

21 Claims, 26 Drawing Sheets

LID WITH ACTUATOR FOR VALVE ASSEMBLY

CROSS-REFERENCE TO RELATED APPLICATION

This application claims the benefit of U.S. Provisional Patent Application No. 62/720,018 filed Aug. 20, 2018.

FIELD OF INVENTION

The present invention relates to a lid with an actuator for closing a beverage container.

BACKGROUND

Certain beverage containers are known to use lids with closing features or structures to prevent or reduce spillage or leakage of fluids contained in the beverage containers. Many such beverage containers may still spill or leak when inverted or tipped over. Many such beverage containers may still spill or leak when fluids expand while warm or when containing carbonated beverages.

SUMMARY

Certain aspects of a lid with an actuator for closing a beverage container are shown and described. The lid includes the actuator that opens and closes a dispensing opening of the lid and also opens and closes a valve assembly of the lid to reduce spillage or leakage from the beverage container. Both the body of the actuator and the valve assembly may independently reduce spillage or leakage from the beverage container. In certain aspects, the beverage must first pass through the valve assembly before the beverage reaches the dispensing opening to exit the beverage container.

The actuator is moved by the user to open and close the dispensing opening and to also open and close the valve assembly. When the user moves the actuator, the dispensing opening and the valve assembly may be simultaneously opened or closed. Thus, a single movement of the actuator may uncover the dispensing opening and open the valve assembly.

The valve assembly provides extra protection against unwanted spillage or leakage from the beverage container equipped with the lid. The actuator may generally close the lid and reduce unwanted spillage or leakage. The valve assembly further generally closes the lid to reduce unwanted spillage or leakage.

In certain aspects, the actuator is positioned above the dispensing opening to generally block liquid from passing through. In certain aspects, the valve assembly is positioned below the dispensing opening to generally block liquid from passing through from below, for example, when the lid is attached to a beverage container storing a liquid beverage.

The valve assembly includes a valve body having a valve stem. The valve stem is engaged to a stem retainer that is positioned in the lid. The actuator includes a lower surface. When the actuator moves relative to the lid, the lower surface of the actuator contacts the stem retainer to open the valve assembly. The actuator may be a sliding member, a twisting member, a magnetic assembly, a lever member, a button member, or other element known in the art. Depending on the embodiment, the user may push, pull, slide, twist, turn, move, or otherwise actuate the actuator to open the valve assembly.

In certain aspects, the valve assembly is opened when a lower surface of the actuator contacts the stem retainer to drive the stem retainer downward, which also moves the valve stem and the entire valve body downward to open the valve assembly. In certain aspects, a lower surface of the actuator has a sloped or angled surface that engages an upper surface of the stem retainer that also has a sloped or angled surface to drive the stem retainer downward. In other aspects, the lower surface of the actuator may directly contact the valve stem to drive it and the rest of the valve body downward to open the valve assembly.

In one aspect, a lid assembly is described. The lid assembly may include a lid body having an indentation in the upper surface of the lid body and a dispensing opening passing through the lid body. The lid assembly includes an actuator movably engaged within the indentation. The actuator includes a sloped lower surface. The lid assembly includes a valve assembly having a valve body which includes a valve stem. The valve stem is configured to pass through at least part of the lid body. The lid assembly includes a stem retainer in a cavity of the lid body. The stem retainer includes a sloped upper surface. The stem retainer engages with the valve stem. The sloped lower surface of the actuator is positioned over the sloped upper surface of the stem retainer. The sloped lower surface of the actuator engages with the sloped upper surface of the stem retainer to drive the stem retainer downward.

In another aspect, a lid assembly is described. The lid assembly includes a lid body, which may have an indentation in an upper surface of the lid body and a dispensing opening passing through the lid body. An actuator is movably engaged relative to the indentation. The lid assembly includes a valve assembly, which includes a valve body having a valve stem. The lid assembly includes a stem retainer positioned in a cavity of the lid body. The stem retainer engages with the valve stem. The actuator is configured to move to an open position and to a closed position. In the open position, the actuator uncovers the dispensing opening and opens the valve assembly. In the closed position, the actuator covers the dispensing opening and closes the valve assembly.

In a further aspect, a lid assembly is described. The lid assembly includes a lid body having an indentation in an upper surface of the lid body and a dispensing opening passing through the lid body. An actuator may be movably engaged to the indentation to alternatively open or cover the dispensing opening. The actuator includes a lower surface, and the lower surface has a first sloped portion. The lid assembly includes a valve assembly having a valve body, which may feature a valve stem and a valve body plate. The valve stem is configured to pass through at least part of a central passage of the lid body. A stem retainer is positioned in a cavity of the lid body over the central passage. The stem retainer includes an upper surface, and the upper surface has a second sloped portion. The stem retainer engages with the valve stem. The first sloped portion of the actuator is positioned over the second sloped portion of the stem retainer. An opening movement of the actuator drives the first sloped portion of the actuator against the second sloped portion of the stem retainer to drive the lid body downward.

Certain aspects of the lid assembly may be disassembled to permit easy cleaning or repairs. For example, in some aspects, the stem retainer may removably engage with the valve stem, such that a valve stem may completely separate from the stem retainer. In such an aspect, when the valve body has a single piece construction, this piece is entirely removable upon release of the valve stem from the stem retainer. In certain aspects, also upon detaching the valve stem and stem retainer, the stem retainer, valve body, and lid body can be separated from each other and other lid components for cleaning or replacement/repair. The actuator also may be detachably engagable with the lid such that the actuator can be cleaned, repaired, or replaced as well. In other aspects, the valve assembly and/or the actuator are intended to be dissembled or removed from the lid body.

DETAILED DESCRIPTION OF INVENTION

Figure 1:
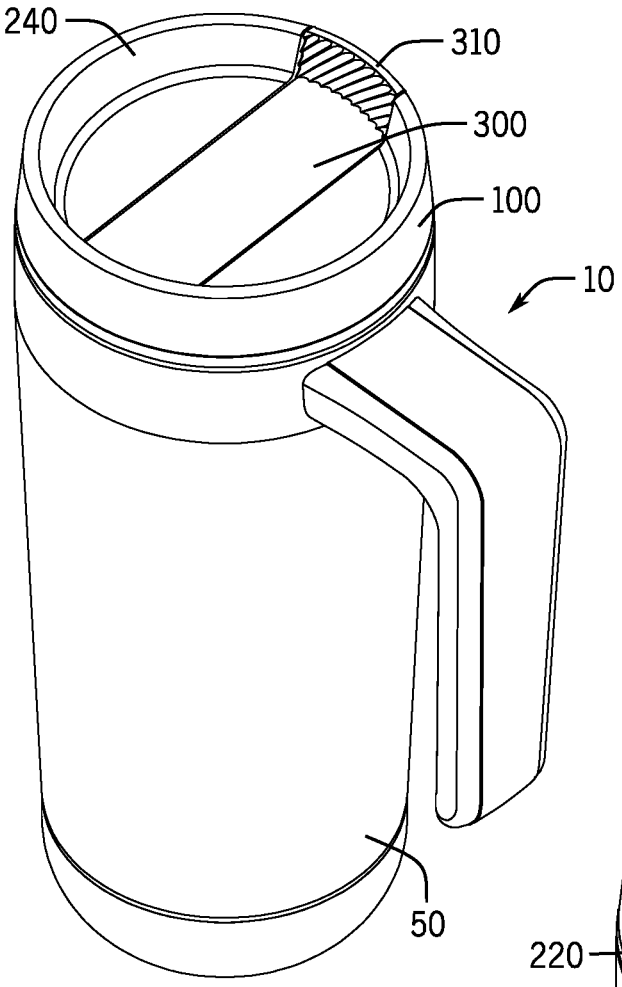
FIG. 1 is a perspective view of the beverage container assembly.

For purposes of this application, any terms that describe relative position (e.g., "upper", "middle" "lower", "outer", "inner", "above", "below", "bottom", "top", etc.) refer to an aspect of the invention as illustrated, but those terms do not limit the orientation in which the embodiments can be used.

A beverage container assembly 10 will now be described with reference to FIGS. 1-11. The beverage container assembly 10 includes a beverage container 50 to hold a beverage and a lid assembly 100 to selectively close the beverage container 50. The lid assembly 100 may engage with the beverage container 50 to form the beverage container assembly 10.

The lid assembly 100 includes an actuator 300 that opens and closes a dispensing opening 220 of the lid assembly 100 and also actuates a valve assembly 400 of the lid assembly 100. The actuator 300 moves to uncover or open the dispensing opening 220 while simultaneously opening the valve assembly 400. A lower surface 340 of the actuator 300 blocks or covers the dispensing opening 220. The valve assembly 400 provides extra protection against the beverage container assembly 10 from leaking when the actuator 300 is in a closed position covering up the dispensing opening 220. In other aspects, the actuator 300 merely opens and closes the valve assembly 400, and does not also block or cover the dispensing opening 220.

The actuator 300 may be a sliding member, a twisting member, a magnetic assembly, a lever member, a button member, or other element known in the art. Depending on the embodiment, the user may push, pull, slide, twist, turn, move, or otherwise actuate the actuator 300 to open the valve assembly 400 and/or cover the dispensing opening 220.

An actuator 300 configured as a sliding member may move in a generally lateral direction to uncover or open the dispensing opening 220 while simultaneously opening the valve assembly 400. The actuator 300 may move generally perpendicular to a vertical axis of the beverage container 50. When fully moved to its maximum extent, a portion of the actuator 300 may extend beyond a rim 240 of a lid body 200 of the lid assembly 100. In the opening movement of the actuator 300, the actuator 300 is moving outward from a center of the lid body 200 and toward the rim 240. In other aspects, a sliding member version of an actuator 300 merely slides in an indentation that is smaller than the circumference of the upper lid surface. Such a version of a sliding member may include a handle to facilitate the user moving such sliding member.

Figure 2:
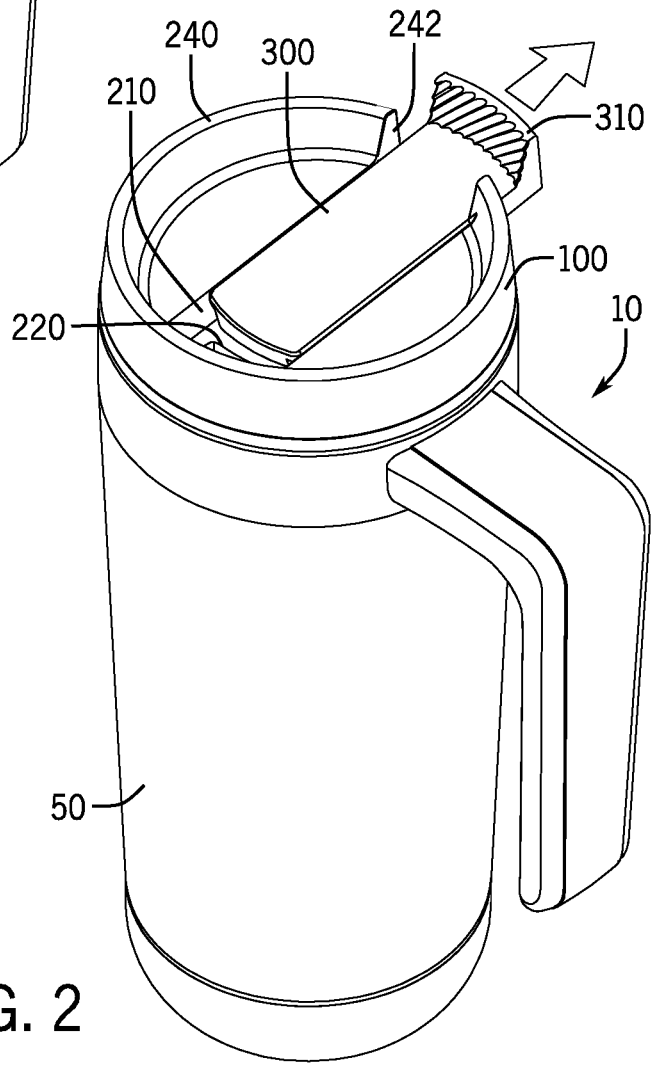
FIG. 2 is a perspective view of the beverage container assembly with the actuator moved to the open position.
Figure 3:
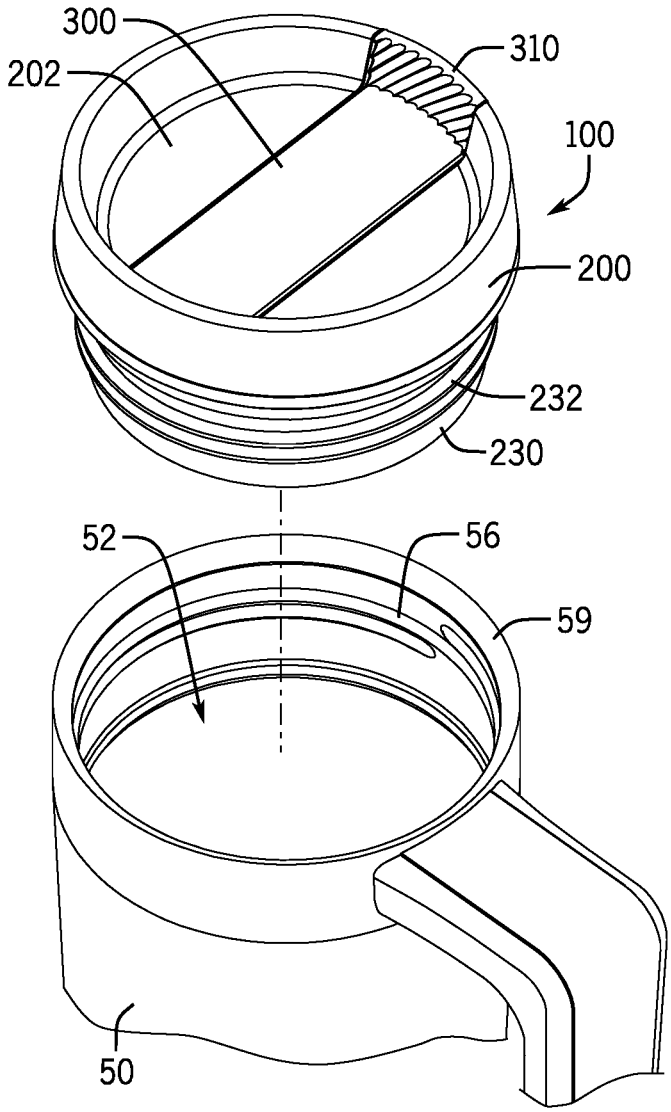
FIG. 3 is an exploded view of the beverage container assembly.

As shown in FIGS. 1-3, the lid assembly 100 includes the lid body 200. The lid body 200 is shaped and configured to close an opening 52 of the beverage container 50. The lid body 200 includes a lower outer wall 230 that forms an engaging member 232 to removably engage with an engaging member 56 of the beverage container 50. In this aspect, the lower outer wall 230 enters the opening 52 of the beverage container 50. The engaging member 232 and the engaging member 56 may include a complementary components of a threaded engagement, snap-fit engagement, frictional engagement, bayonet engagement, or other engagements configured to selectively attach the lid body 200 to the beverage container 50.

Figure 7:
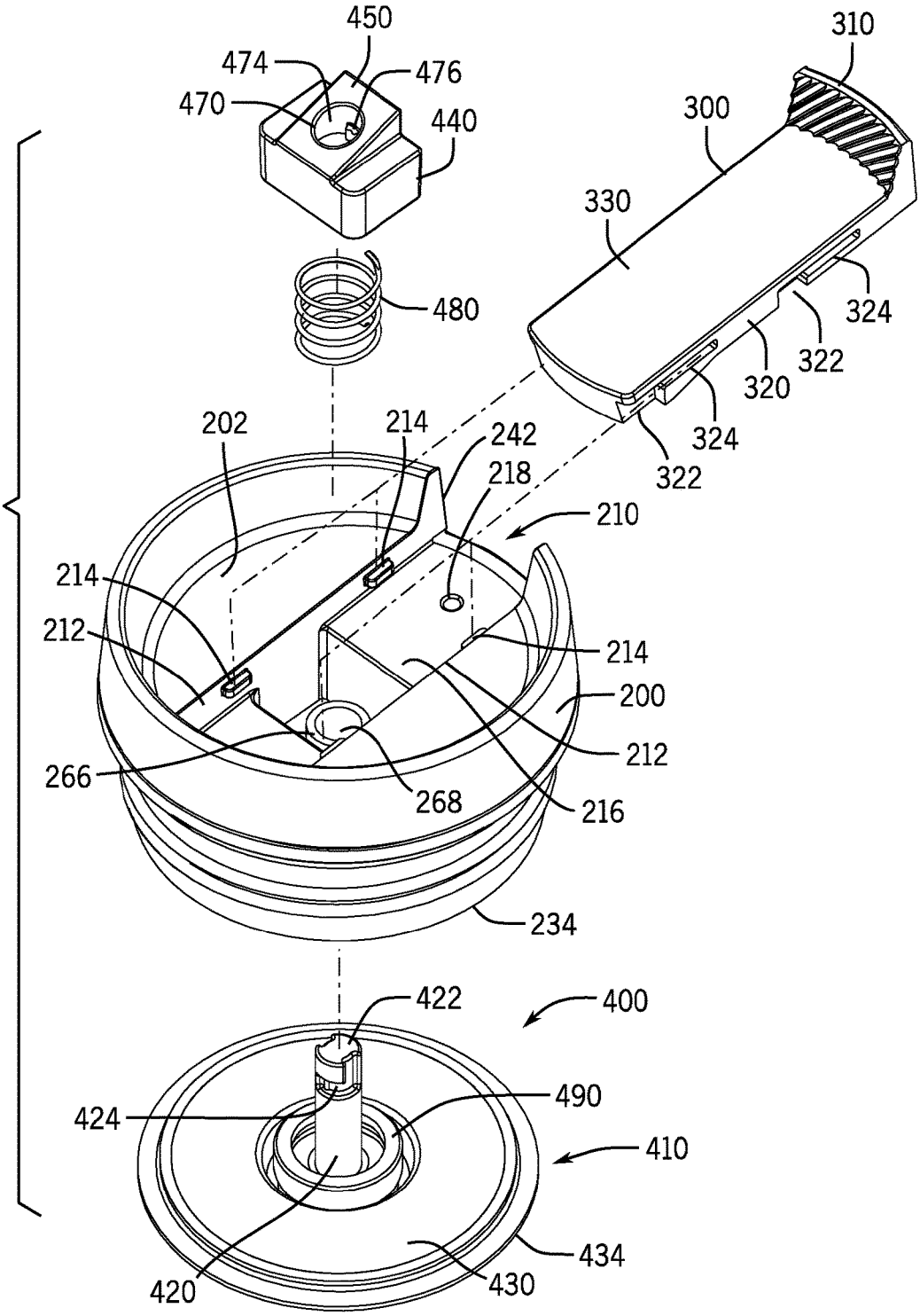
FIG. 7 is an exploded upper view of the lid assembly.

The lid assembly 100 will now be described with reference to FIG. 7. The lid assembly 100 includes the lid body 200 that includes the dispensing opening 220. The dispensing opening 220 generally extends from an upper surface 202 of the lid body 200, through the lid body 200, and to a lower surface 204 of the lid body 200 to permit liquids to pass therethrough when open. The dispensing opening 220 may be sized or configured differently depending on the intended use of the lid assembly 100. For example, if the lid assembly 100 is intended to be used with a smaller volume beverage container 50 or intended for hot beverages, then the dispensing opening 220 may include a smaller dimensioned opening. For example, if the lid assembly 100 is intended to be used with a larger volume beverage container 50 intended for cold beverages, then the dispensing opening 220 may include a larger dimensioned opening. The upper surface 202 of the lid body 200 may generally slope or angle toward to the dispensing opening 220, which helps drips of fluid to flow back down through the dispensing opening 220.

The lid body 200 includes the actuator 300, configured as a sliding member in this aspect, to slidably move to open and close the dispensing opening 220. The actuator 300 is movably engaged to the lid body 200. The illustrated lid body 200 includes an indentation 210 in its upper surface 202 that receives the actuator 300 in the movable engagement. The indentation 210 includes indentation sidewalls 212 having protrusions 214 that removably engage with the actuator 300. A bottom surface 216 of the indentation 210 includes a vent opening 218 to vent an interior of the beverage container 50 when the lid assembly 100 is engaged to the beverage container 50. The vent opening 218 runs through the entire indentation bottom surface 216 to permit release of air or gas therethrough.

The lid body 200 further includes the lower outer wall 230 that forms the engaging member 232. In this aspect, the lower outer wall 230 engages to an inner wall 58 of the beverage container 50.

Figure 4:
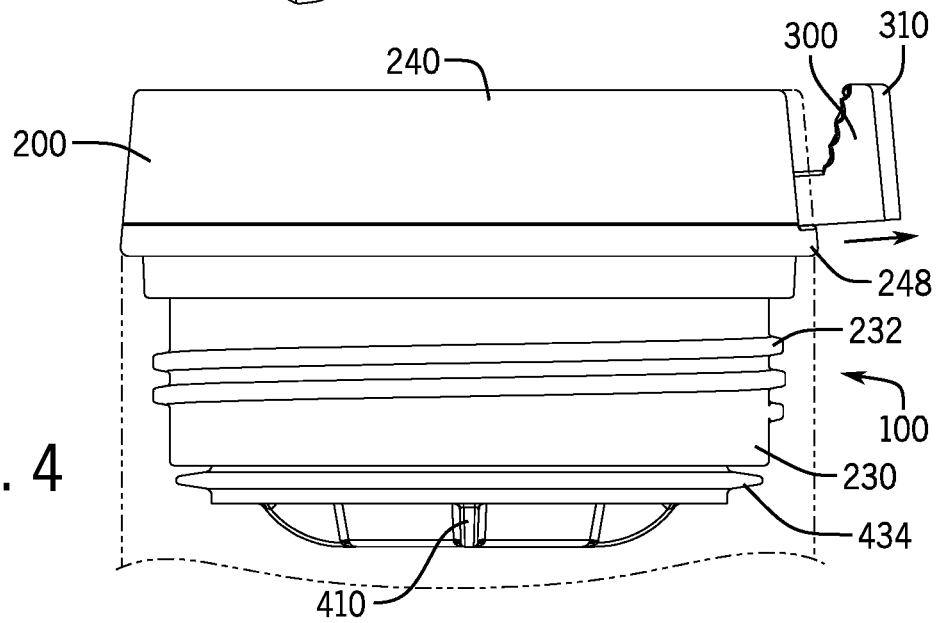
FIG. 4 is a side view of the lid assembly.
Figure 5:
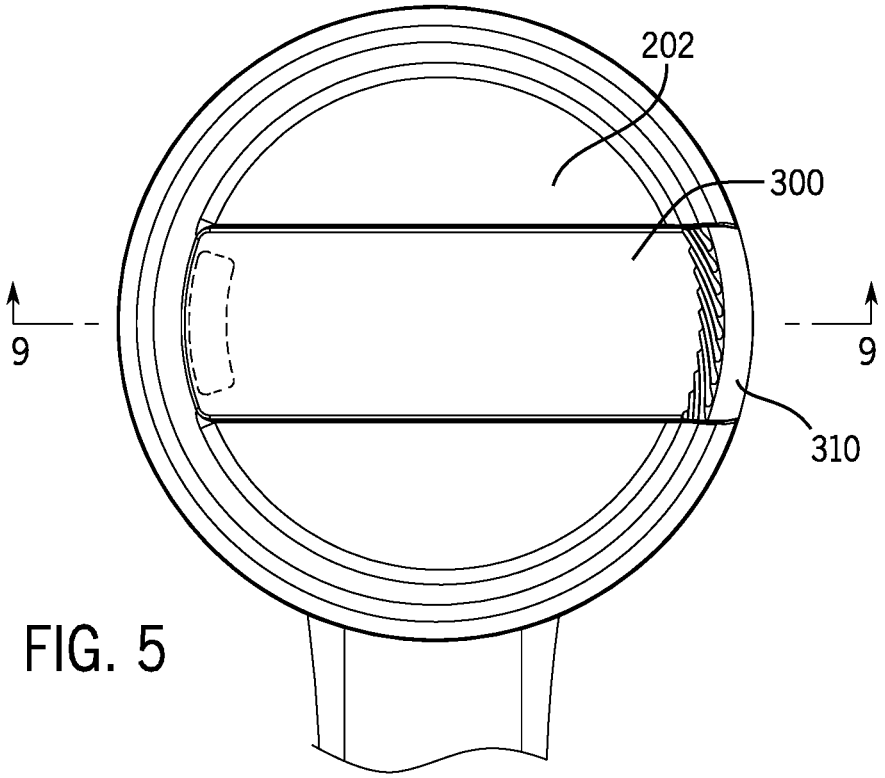
FIG. 5 is a top view of the beverage container assembly.
Figure 6:
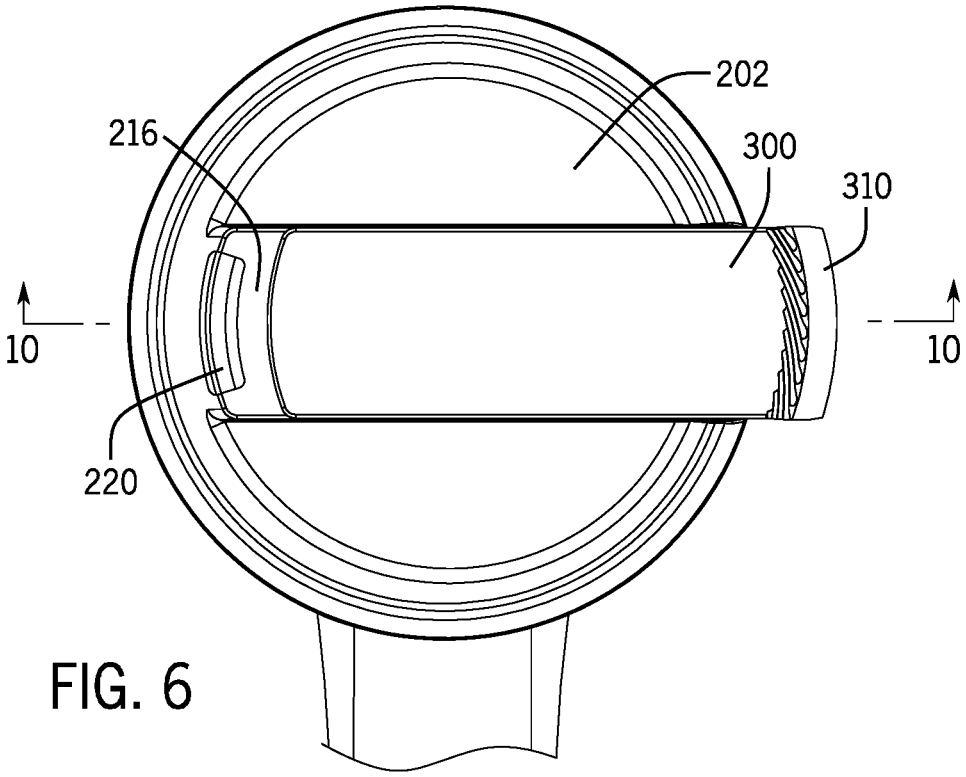
FIG. 6 is a top view of the beverage container assembly with the actuator moved to the open position.

As shown in FIG. 2, the lid body 200 further includes the rim 240 having a rim opening 242. The actuator 300 may slide or pass through the rim opening 242 when the actuator 300 is moved to the open position. The rim opening 242 is sized to permit the actuator 300 or a portion thereof to pass through the rim opening 242. As shown in FIG. 4, the lid body 200 further includes a lid gasket 248 positioned below the rim 240 that seals against an upper rim 59 of the beverage container 50.

Figure 10:
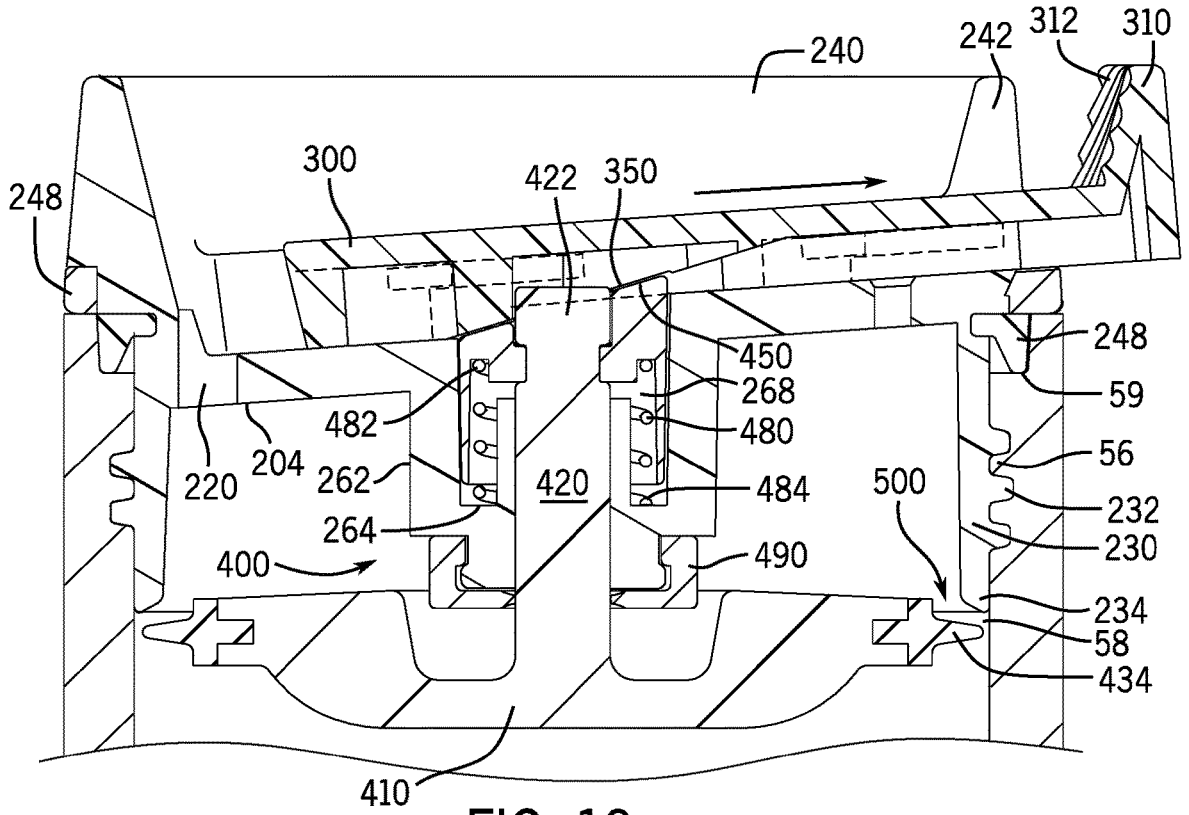
FIG. 10 is a sectional view of lid assembly with the actuator moved to the open position.

As shown in FIG. 10, the lid body 200 further includes a cavity 260. The lid body 200 includes descending walls 262 that extend below the indentation bottom surface 216 to form the cavity 260. The cavity 260 is sized and shaped to receive the stem retainer 440. The cavity 260 includes a lower interior surface 264 having a guide member 266 (shown in FIG. 7) that defines a central passage 268, which passes through the lid body 200.

In certain aspects, the actuator 300 includes a tab 310 that extends upward from an upper surface 330 of the actuator 300. An inner portion of the tab 310 may include a textured grip 312. The tab 310 is sized and shaped to permit a user to push or hold to move the actuator 300 to an open position or a closed position.

In certain aspects, the body of the actuator 300 includes sidewalls 320 having a bayonet opening 322, which leads to a bayonet channel 324. As illustrated, some aspects of the actuator 300 include multiple bayonet openings 322 and respective bayonet channels 324 (possibly just one or two or more on each sidewall 320). When the actuator 300 is engaged to the lid body 200, the protrusions 214 of the indentation sidewalls 212 enter into the bayonet opening 322 of the sidewalls 320 to slidably lock the actuator 300 to the lid body 200. As the actuator 300 slides relative to the lid body 200, the protrusions 214 pass from the bayonet openings 322 into the bayonet channels 324, which provide a length of travel for the protrusions 214.

Figure 8:
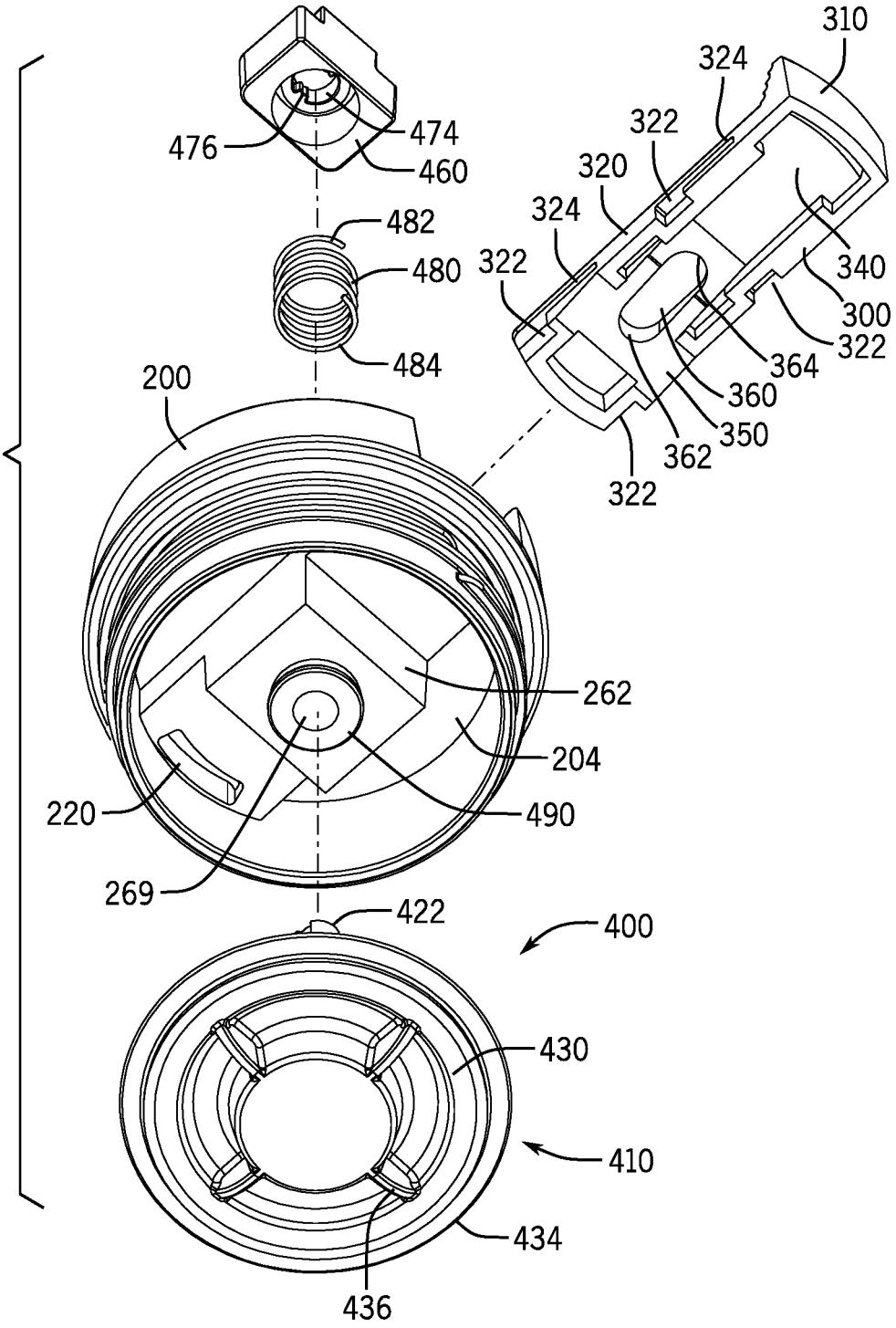
FIG. 8 is an exploded lower view of the lid assembly.

With reference to FIG. 8, the actuator 300 further includes a lower surface 340 forming a lower sloping surface 350. The lower surface 340 further includes a channel 360. The channel 360 includes a first channel end 362 and a second channel end 364. When the actuator 300 slides relative to the lid body 200, the lower sloping surface 350 urges against an upper sloping surface 450 of the stem retainer 440 to open the valve assembly 400. As described below, the first channel end 362 and the second channel end 364 provide a limit to the sliding movement of the actuator 300.

Figure 11:
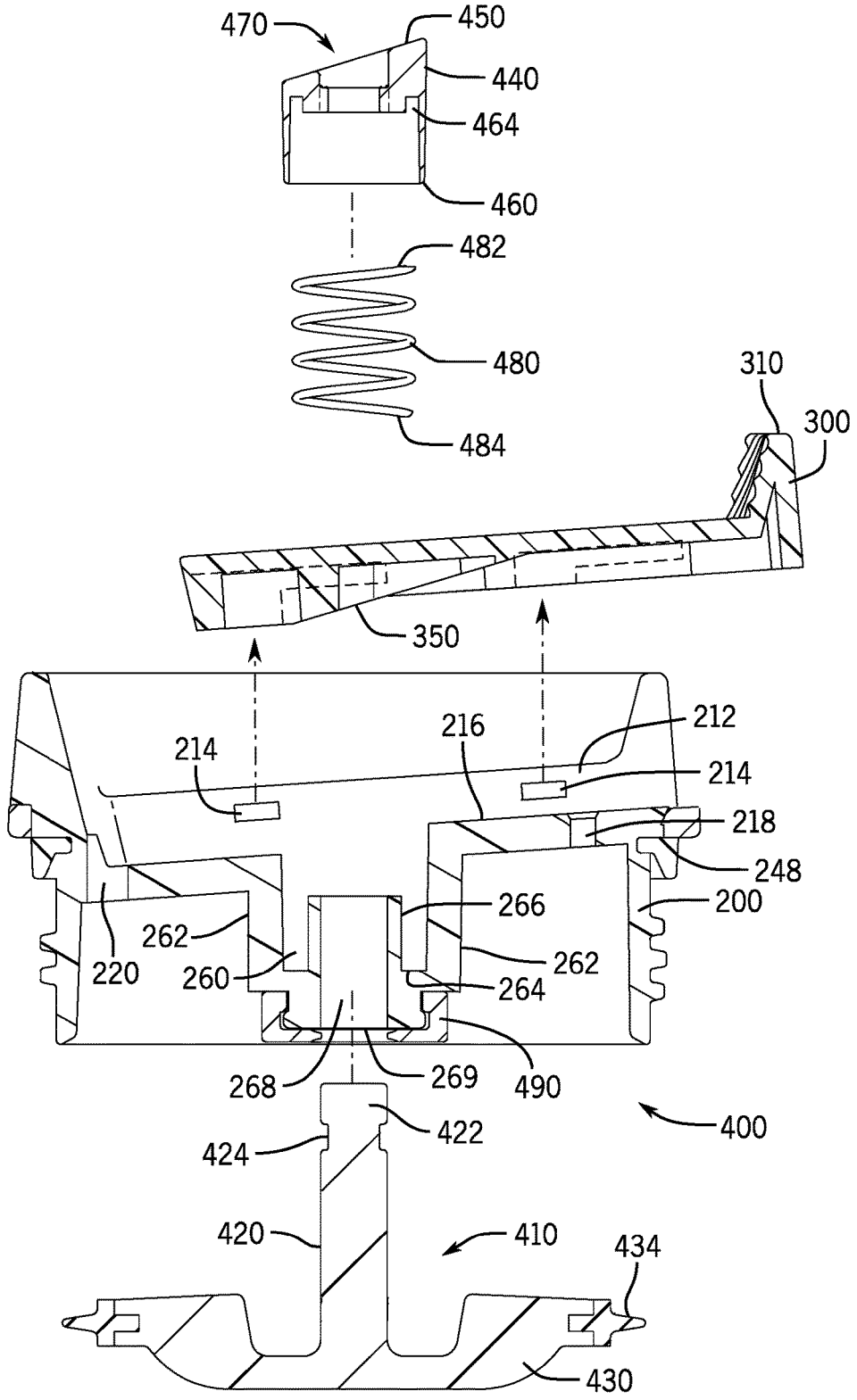
FIG. 11 is an exploded view of the valve assembly.

The valve assembly 400 will now be described with reference to FIG. 11. The valve assembly 400 includes a valve body 410. The valve body 410 includes a valve stem 420 extending from a valve body plate 430. The valve stem 420 may extend generally perpendicular to the valve body plate 430. In certain aspects, the valve stem 420 may be integrally molded to the valve body plate 430. In alternative aspects, the valve stem 420 and the valve body plate 430 may be two separate pieces with some connection structure known in the art. In yet additional aspects, a stem retainer could have a descending stem that is integrally molded therewith, and the valve body plate (a separate piece) could be removably connected by any appropriate connection structure known in the art.

A valve body plate gasket 434 may be positioned around a perimeter of the valve body plate 430. The valve body plate 430 may include one or more flanges 436. As shown in FIG. 8, the flanges 436 are formed on bottom surface of the valve body plate 430. The flanges 436 provide a convenient gripping surface when the user wishes to rotate the valve body 410 in order to disengage the valve stem 420 from the stem retainer 440.

The valve stem 420 passes through the central passage 268 of the lid body 200 and into the stem retainer 440 in the cavity 260 and engages with the stem retainer 440. An upper end 422 of the valve stem 420 includes an engaging member 424 that lockingly engages with an engaging member 476 of the stem retainer 440. The engaging member 476 may be positioned in or formed on an inner opening surface 474 of the opening 470 of the stem retainer 440. The engaging members 424 and 476 may include complementary components of a twist-lock, bayonet, threaded or other removable locking engagement. During assembly, the valve stem 420 (and therefore the rest of the valve body 410 when those components form a single piece construction) may be removed from the stem retainer 440 for cleaning purposes.

In operation, the valve body 410 is positioned beneath the lid body 200. The valve stem 420 passes through a stem gasket 490 and through the central passage 268 of the guide member 266. The upper end 422 of the valve stem 420 removably locks with the stem retainer 440. A biasing member 480 urges the valve body 410 to a closed position that reduces leakage of the beverage container assembly 10 when the actuator 300 is in the closed position. The biasing member 480 may include a coil spring, magnet pair, or other biasing member or spring. In certain aspects, the biasing member 480 urges the valve body 410 upward to the closed position.

Figure 9:
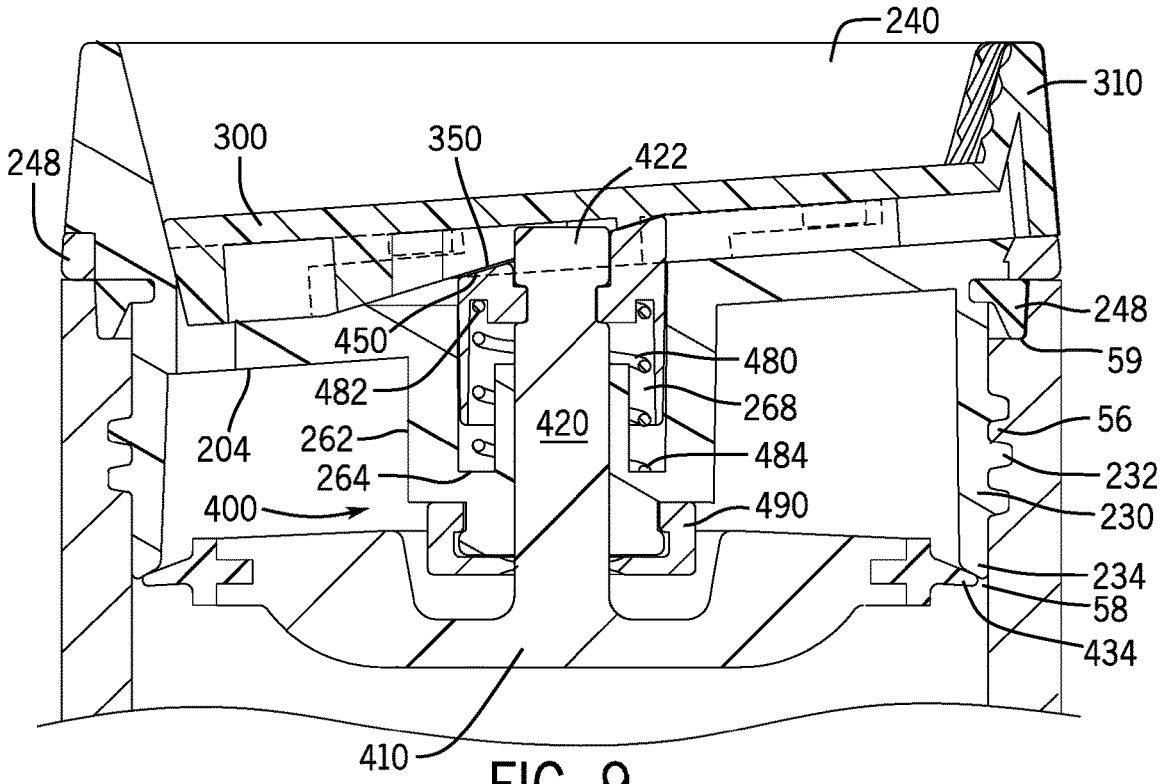
FIG. 9 is a sectional view of the lid assembly with the actuator in the closed position.

In FIG. 9, the valve assembly 400 is closed as the valve body 410 is urged against the lower end 234 of the lower outer wall 230 of the lid body 200. In FIG. 10, a fluid passage 500 is open as the lid body 200 is moved downward to form a gap for fluid travel between a valve body plate gasket 434 and the lower end 234 of the lower outer wall 230 of the lid body 200.

As shown in FIGS. 9 and 10, the fluid passage 500 is opened and closed by moving the valve body 410. The fluid passage 500 is formed between the valve body plate gasket 434 and the lower end 234 of the lower outer wall 230 of the lid body 200. In the closed position, the valve body plate gasket 434 may rub or seal against one or both of the lower end 234 and an inner wall 58 of the beverage container 50. When the valve body 410 is moved downward by the actuator 300 moving to the open position, the fluid passage 500 is opened. When the actuator 300 is moved to the closed position, the biasing member 480 urges the valve body 410 upward to a closed position, which closes the fluid passage 500 to reduce unwanted spillage or leakage of liquid from the beverage container 50.

A fluid contained in the beverage container assembly 10 generally has to pass through the fluid passage 500 before the fluid can reach the dispensing opening 220. The flow of the fluid through the fluid passage 500 is controlled by the valve body 410 and, in certain aspects, the flow of the fluid through the dispensing opening 220 is controlled by the actuator 300. Thus, the lid assembly 100 of the beverage container assembly 10 provides multiple checks or measures to stop unwanted spillage or leakage of liquid from the beverage container 50.

In this aspect, a lower end 484 of the biasing member 480 urges against the lower interior surface 264 of the cavity 260. The biasing member 480 may be fit over the guide member 266 of the cavity 260 and the valve stem 420 may pass through an interior of the biasing member 480. An upper end 482 of the biasing member 480 may urge against the groove 464 formed in a lower surface 460 of the stem retainer 440, which drives the stem retainer 440 upward.

When the actuator 300, configured as a sliding member embodiment, is slidably moved relative to the lid body 200, the upper end 422 of the valve stem 420 is positioned in the channel 360 of the lower surface 340 of the actuator 300. A length of the channel 360 limits an amount of movement of the actuator 300. The actuator 300 may move laterally until a side surface of the upper end 422 of the valve stem 420 contacts the first channel end 362 or the second channel end 364 of the channel 360.

When the actuator 300 moves to the open position, the lower sloping surface 350 of the actuator 300 is urged against the upper sloping surface 450 of the stem retainer 440. The engagement of the lower sloping surface 350 and the upper sloping surface 450 is shown in FIGS. 9 and 10. This engagement drives the stem retainer 440 in a downward direction (overcoming the bias of the biasing member 480) and likewise drives the valve stem 420 downward to open up the fluid passage 500. In the aspect of FIGS. 9 and 10, the actuator 300 is moving to the right side to be in the open position. As the actuator 300 moves to the right, the larger section of the lower sloping surface 350 presses against the larger section upper sloping surface 450. The engagement of the lower sloping surface 350 pressing against the upper sloping surface 450 converts the generally lateral movement of the actuator 300 to the downward movement of the stem retainer 440. The lower sloping surface 350 and the upper sloping surface 450 form two interacting wedges or ramps that translate the opening movement of the actuator 300 to further open the valve assembly 400.

During the opening movement of the actuator 300 as illustrated, the actuator 300 is held to the lid body 200 by the engagement of the protrusions 214 of the indentation sidewalls 212 of the lid body 200 with the bayonet opening 322 and bayonet channel 324 of the sidewall 320 of the actuator 300. The force from the engagement of the lower sloping surface 350 pressing against the upper sloping surface 450 is released downward. Thus, the generally lateral movement of the actuator 300 urges the valve body 410 downward.

The lid assembly 100 may be easily disassembled for cleaning. The lid assembly 100 is first removed from the beverage container 50. The valve body 410 is twisted to free the engaging member 424 of the valve stem 420 from the engaging member 476 of the stem retainer 440. The valve body 410 may be pulled from the lid body 200 and the valve stem 420 is withdrawn from the central passage 268 of the guide member 266. Next, the actuator 300 is moved to align the protrusions 214 of the indentation sidewalls 212 with the bayonet openings 322 of the sidewalls 320. The slide member 300 may now be removed from the indentation 210 in the lid body 200. Now, the stem retainer 440 and biasing member 480 may be removed from the cavity 26. In certain aspects, the disassembly steps must or most effectively occur in the order identified in this paragraph, as the actuator 300 cannot be removed from the lid body 200 unless the valve body 410 is not present. Before removal of the valve body 410 in the illustrated embodiment, the valve stem 420 meets with the second channel end 364, which generally blocks movement of the actuator 300 to a position in which it could be removed easily (e.g., the actuator 300 can be removed easily when the bayonet openings 322 align with the protrusions 214).

In order to assemble the lid assembly 100, the biasing member 480 is placed in the cavity 260 and around the guide member 266. The stem retainer 440 is placed in the cavity 260 over the biasing member 480. Next, the actuator 300 is positioned in the indentation 210 of the lid body 200 with the protrusions 214 of the indentation sidewalls 212 aligned with the bayonet openings 322 of the sidewalls 320. The actuator 300 is moved relative to the lid body 200 and the protrusions 214 pass from the bayonet openings 322 into the bayonet channels 324, which lock the actuator 300 to the lid body 200. Then, the upper end 422 of the valve stem 422 is inserted into a lower opening 269 of the central passage 268 of the lid body 200 and the valve stem 420 is passed through the central passage 268 until the upper end 422 is in the opening 470 of the stem retainer 440. The valve body 410 is twisted to engage the engaging member 424 of the valve stem 420 with the engaging member 476 of the stem retainer 440. In certain aspects, the assembly steps must or most effectively occur in the order identified in this paragraph.

A lid assembly 600 and a beverage container assembly 11 will now be described with reference to FIGS. 12-23. The lid assembly 600 generally operates in a similar manner to the lid assembly 100, i.e., an actuator 605 is moved by the user to open and close a dispensing opening 610 and to also open and close a valve assembly 620. However, the lid assembly 600 is not intended to be disassembled. In the lid assembly 600, the actuator 605 and the valve assembly 620 are not intended to be removed from a lid body 615.

The lid assembly 600 includes the actuator 605 that opens and closes the dispensing opening 610 of the lid assembly 600 and also actuates the valve assembly 620 of the lid assembly 600. The actuator 605 moves to uncover or open the dispensing opening 610 while simultaneously opening the valve assembly 620. A lower surface 625 of the actuator 605 blocks or covers the dispensing opening 610. The valve assembly 620 provides extra protection against the beverage container assembly 11 from leaking when the actuator 605 is in a closed position covering up the dispensing opening 610. In other aspects, the actuator 605 merely opens and closes the valve assembly 620, and does not also block or cover the dispensing opening 610.

The actuator 605 may be a sliding member, a twisting member, a magnetic assembly, a lever member, a button member, or other element known in the art. Depending on the embodiment, the user may push, pull, slide, twist, turn, move, or otherwise actuate the actuator 605 to open the valve assembly 620 and/or cover the dispensing opening 610.

The actuator 605 configured as a sliding member may move in a generally lateral direction to uncover or open the dispensing opening 610 while simultaneously opening the valve assembly 620. The actuator 605 may move generally perpendicular to a vertical axis of the beverage container 50 when the lid assembly 600 is engaged with the beverage container 50. When fully moved to its maximum extent, a portion of the actuator 605 may extend beyond a rim 630 of the lid body 615 of the lid assembly 600. In the opening movement of the actuator 605, the actuator 605 is moving outward from a center of the lid body 615 and toward the rim 630. In other aspects, a sliding member version of an actuator 605 merely slides in an indentation that is smaller than the circumference of the upper lid surface. Such a version of a sliding member may include a handle to facilitate the user moving such sliding member.

Figure 14:
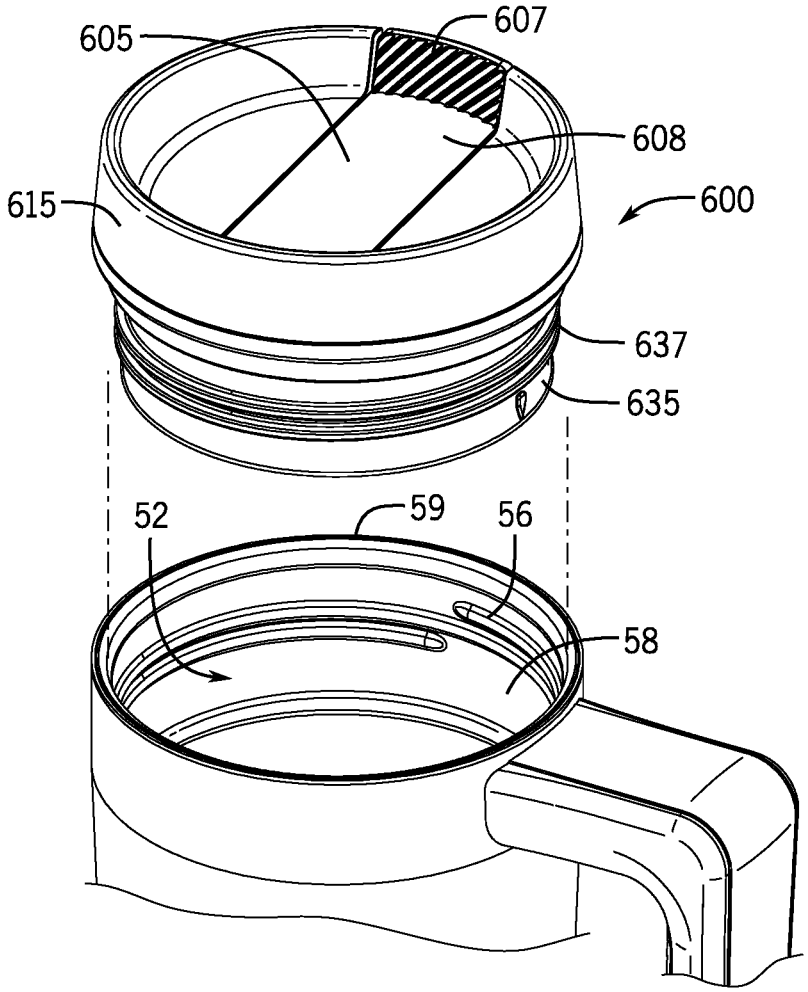
FIG. 14 is an exploded view of the second beverage container assembly.
Figure 15:
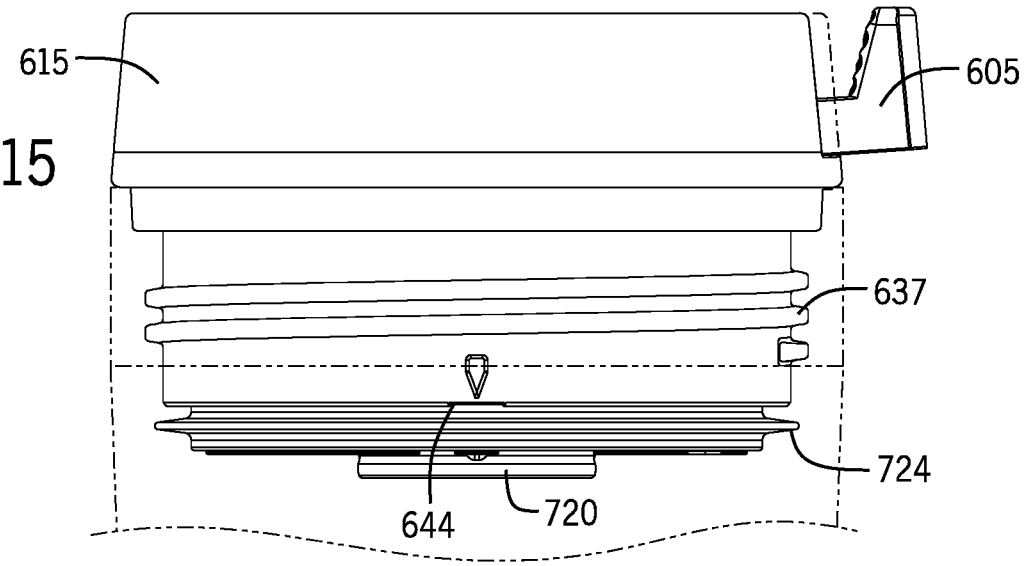
FIG. 15 is a side view of the lid assembly of the second beverage container assembly.
Figure 16:
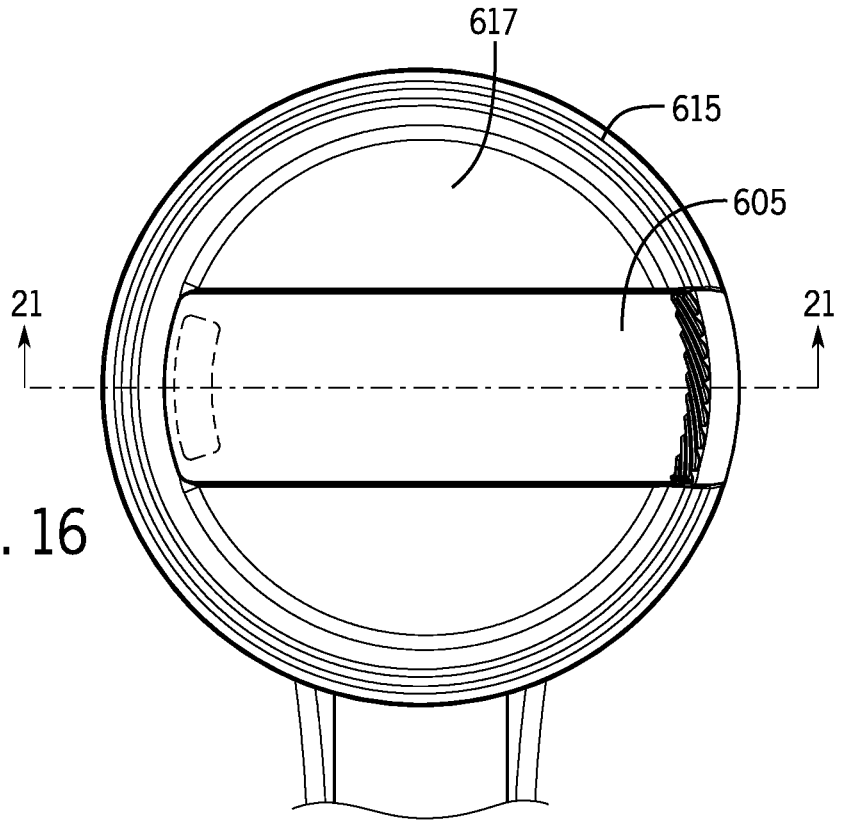
FIG. 16 is a top view of the second beverage container assembly.
Figure 17:
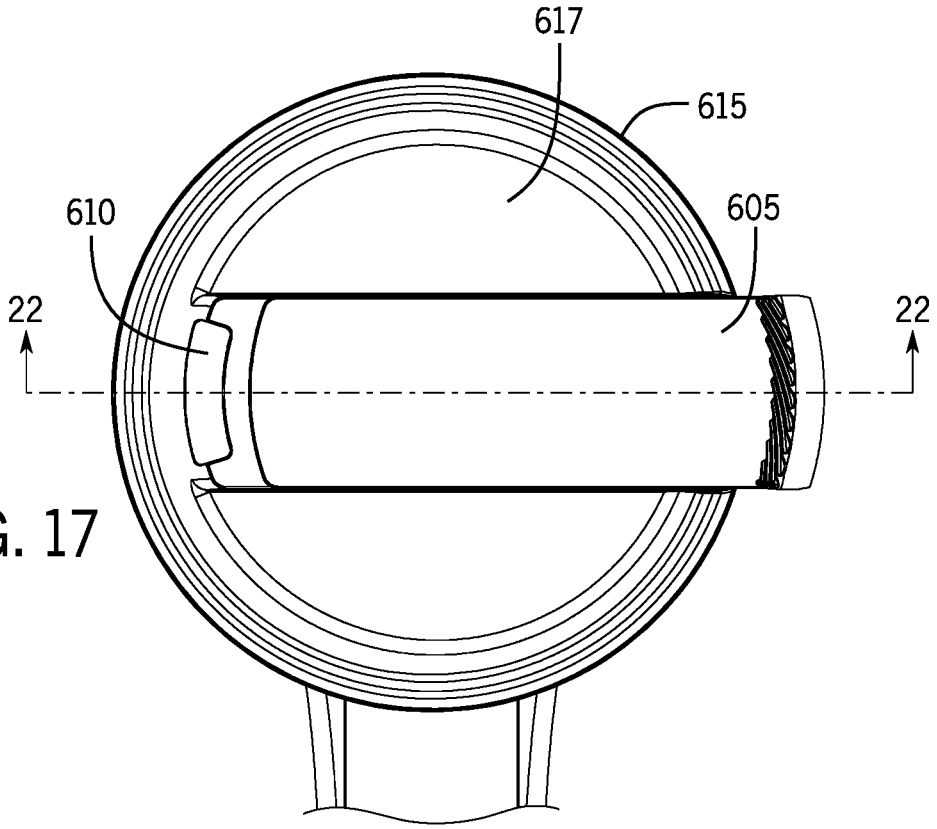
FIG. 17 is a top view of the second beverage container assembly with the actuator moved to the open position.

As shown in FIG. 14, the lid assembly 600 includes the lid body 615. The lid body 615 is shaped and configured to close the opening 52 of the beverage container 50. The lid body 615 includes a lower outer wall 635 that forms an engaging member 637 to removably engage with the engaging member 56 of the beverage container 50. In this aspect, the lower outer wall 635 enters the opening 52 of the beverage container 50. The engaging member 637 and the engaging member 56 may include a complementary components of a threaded engagement, snap-fit engagement, frictional engagement, bayonet engagement, or other engagements configured to selectively attach the lid body 615 to the beverage container 50.

The lid assembly 600 will now be described with reference to FIG. 18. The lid assembly 600 includes the lid body 615 that includes the dispensing opening 610. The dispensing opening 610 generally extends from an upper surface 617 of the lid body 615, through the lid body 615, and to a lower surface 619 of the lid body 615 to permit liquids to pass therethrough when open. The dispensing opening 610 may be sized or configured differently depending on the intended use of the lid assembly 600. For example, if the lid assembly 600 is intended to be used with a smaller volume beverage container 50 or intended for hot beverages, then the dispensing opening 610 may include a smaller dimensioned opening. For example, if the lid assembly 600 is intended to be used with a larger volume beverage container 50 intended for cold beverages, then the dispensing opening 610 may include a larger dimensioned opening. The upper surface 617 of the lid body 615 may generally slope or angle toward to the dispensing opening 610, which helps drips of fluid to flow back down through the dispensing opening 610.

The lid body 615 includes the actuator 605, configured as a sliding member in this aspect, to slidably move to open and close the dispensing opening 610. The actuator 605 is movably engaged to the lid body 615. The illustrated lid body 615 includes an indentation 640 in its upper surface 617 that receives the actuator 605 in the movable engagement. The indentation 640 includes indentation sidewalls 642 having protrusions 646 that removably engage with the actuator 605. A bottom surface 645 of the indentation 640 includes a vent opening 647 to vent an interior of the beverage container 50 when the lid assembly 600 is engaged to the beverage container 50. The vent opening 647 runs through the entire indentation bottom surface 645 to permit release of air or gas therethrough.

The lid body 615 further includes the lower outer wall 635 that forms the engaging member 637. In this aspect, the lower outer wall 635 engages to the inner wall 58 of the beverage container 50.

Figure 13:
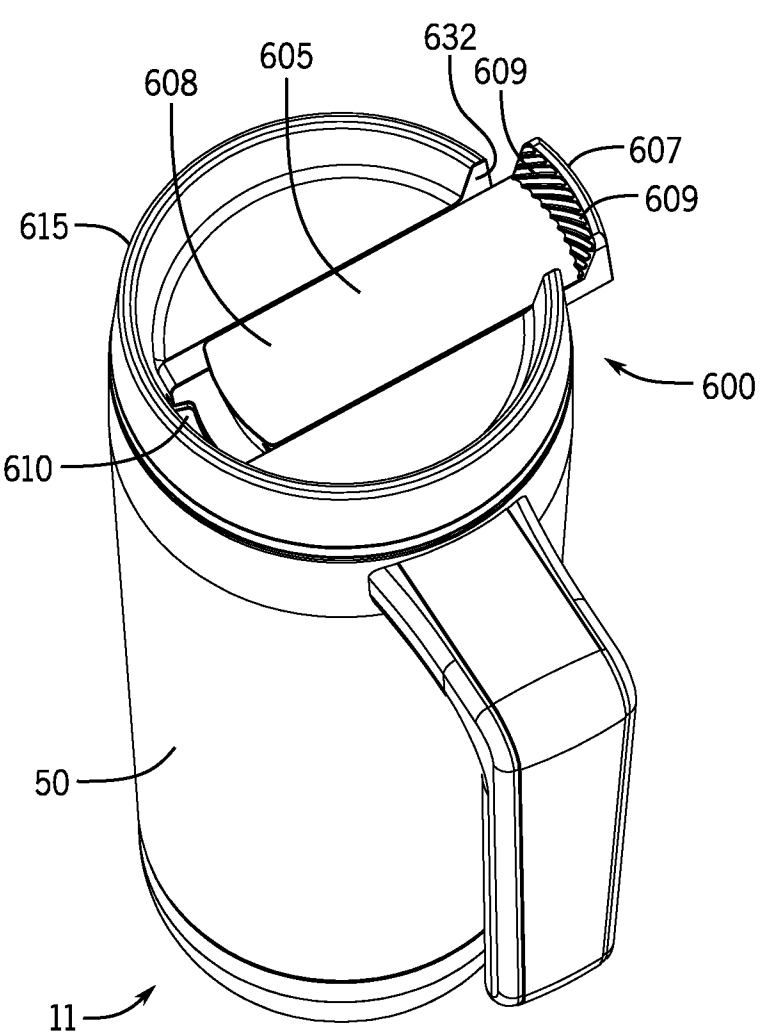
FIG. 13 is a perspective view of the second beverage container assembly with the actuator moved to the open position.
Figure 12:
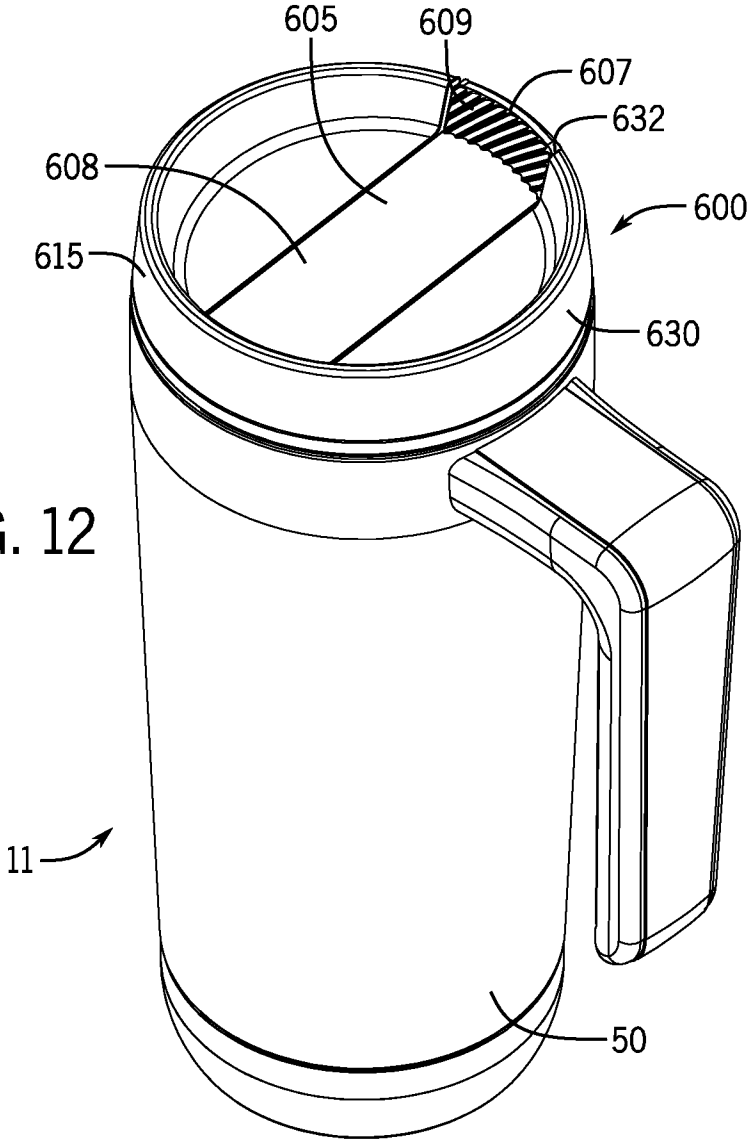
FIG. 12 is a perspective view of the second beverage container assembly.
Figure 21:
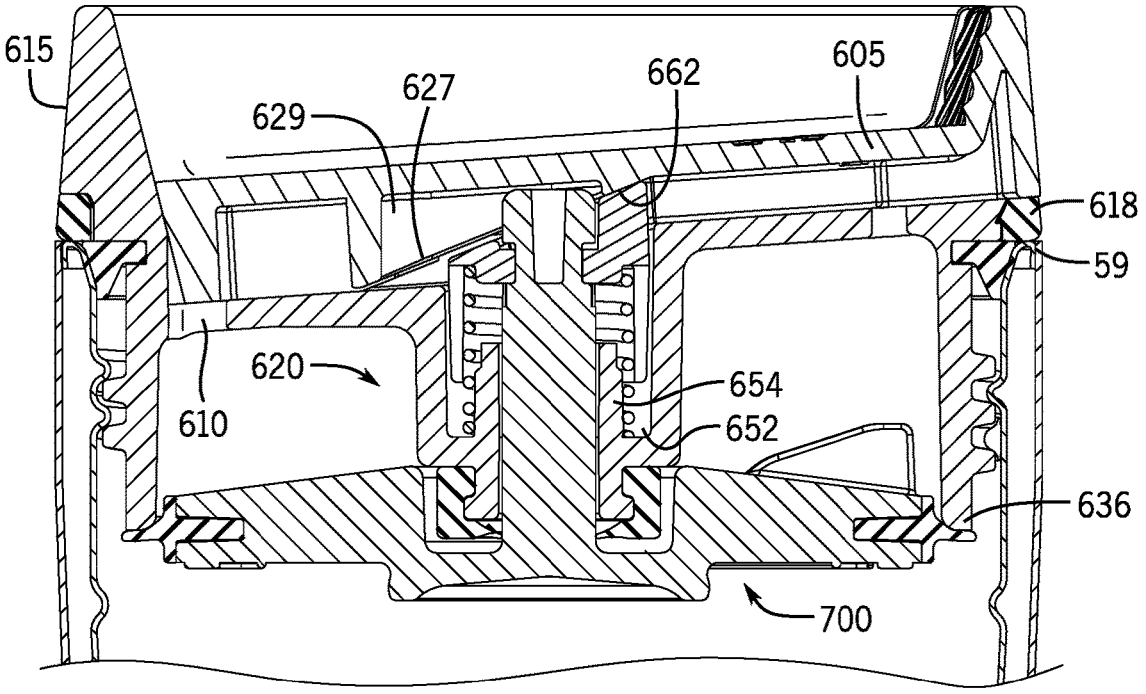
FIG. 21 is a sectional view of the lid assembly of the second beverage container assembly with the actuator in the closed position.

As shown in FIG. 13, the lid body 615 further includes the rim 630 having a rim opening 632. The actuator 605 may slide or pass through the rim opening 632 when the actuator 605 is moved to the open position. The rim opening 632 is sized to permit the actuator 605 or a portion thereof to pass through the rim opening 632. As shown in FIG. 21, the lid body 615 further includes a lid gasket 618 positioned below the rim 630 that seals against an upper rim 59 of the beverage container 50.

Figure 18:
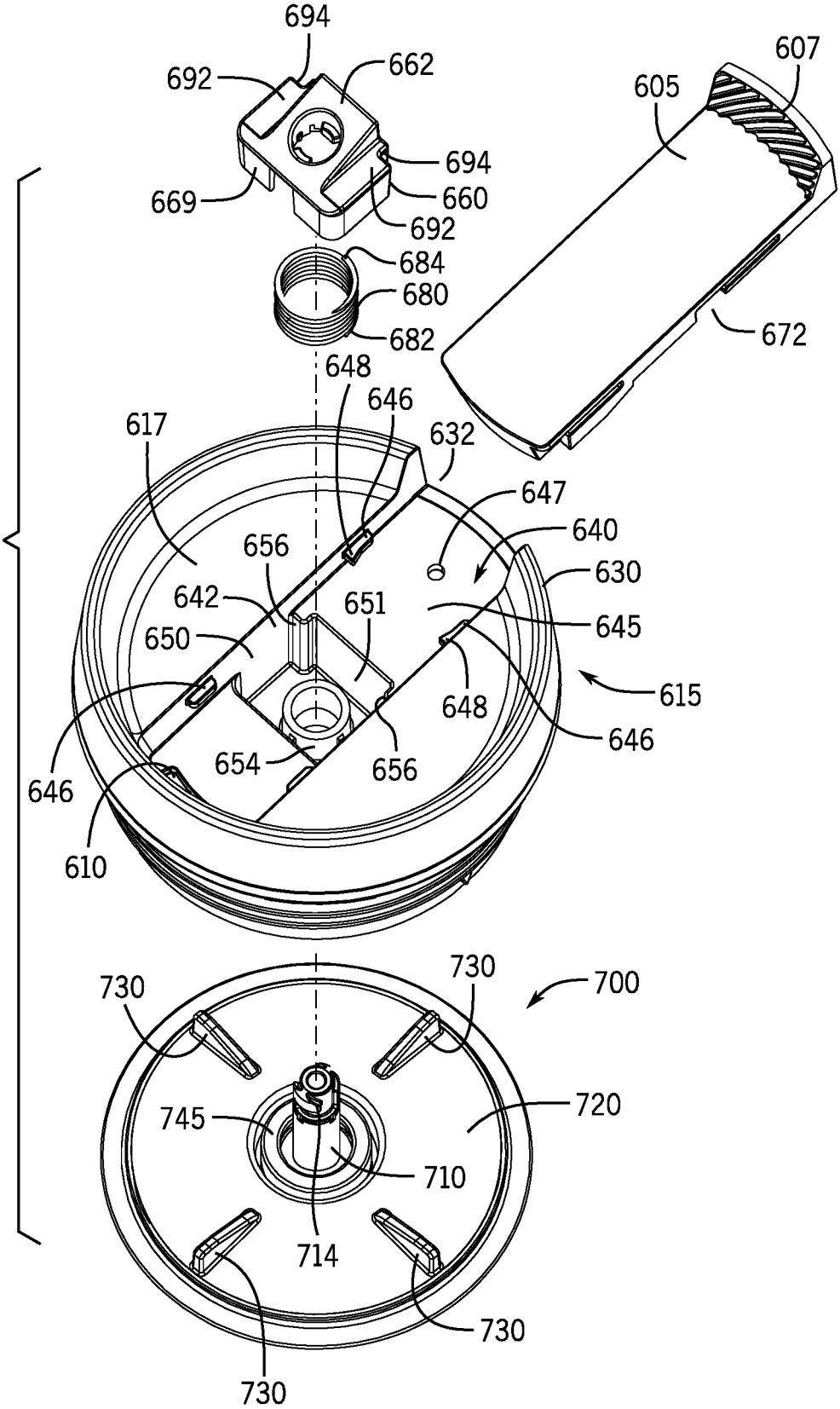
FIG. 18 is an exploded upper view of the lid assembly of the second beverage container assembly.

As shown in FIG. 18, the lid body 615 further includes a cavity 650. The lid body 615 includes descending walls 651 that extend below the bottom surface 645 to form the cavity 650. The cavity 650 is sized and shaped to receive the stem retainer 660. The cavity 650 includes a lower interior surface 652 having a guide member 654 (shown in FIG. 18) that defines a central passage 686, which passes through the lid body 615.

In certain aspects, the actuator 605 includes a tab 607 that extends upward from an upper surface 608 of the actuator 605. An inner portion of the tab 607 may include a textured grip 609. The tab 607 is sized and shaped to permit a user to push or hold to move the actuator 605 to an open position or a closed position.

In certain aspects, the body of the actuator 605 includes sidewalls 670 having a bayonet opening 672, which leads to a bayonet channel 324. As illustrated, some aspects of the actuator 605 include multiple bayonet openings 672 and respective bayonet channels 674 (possibly just one or two or more on each sidewall 670). When the actuator 605 is engaged to the lid body 615, the protrusions 646 of the indentation sidewalls 642 enter into the bayonet opening 672 of the sidewalls 670 to slidably lock the actuator 605 to the lid body 615. As the actuator 605 slides relative to the lid body 615, the protrusions 646 pass from the bayonet openings 672 into the bayonet channels 674, which provide a length of travel for the protrusions 646. In this aspect, the protrusions 646 include a ramp 648 that engages with an incline 676 in the bayonet channel 674 to prevent or minimize the removal of the actuator 605. The interaction of the ramp 648 with the incline 676 helps to prevent the complete removal of the actuator 605. The incline 676 is positioned proximate the bayonet opening 672. When the actuator 605 is moved outwardly sufficiently, the ramps 648 lockingly engage with incline 676 to prevent further movement of the actuator 605. In this aspect, once the actuator 605 is installed on the indentation 640, the actuator 605 is intended to be slidable, but not intended to be removable from the indentation 640.

Figure 19:
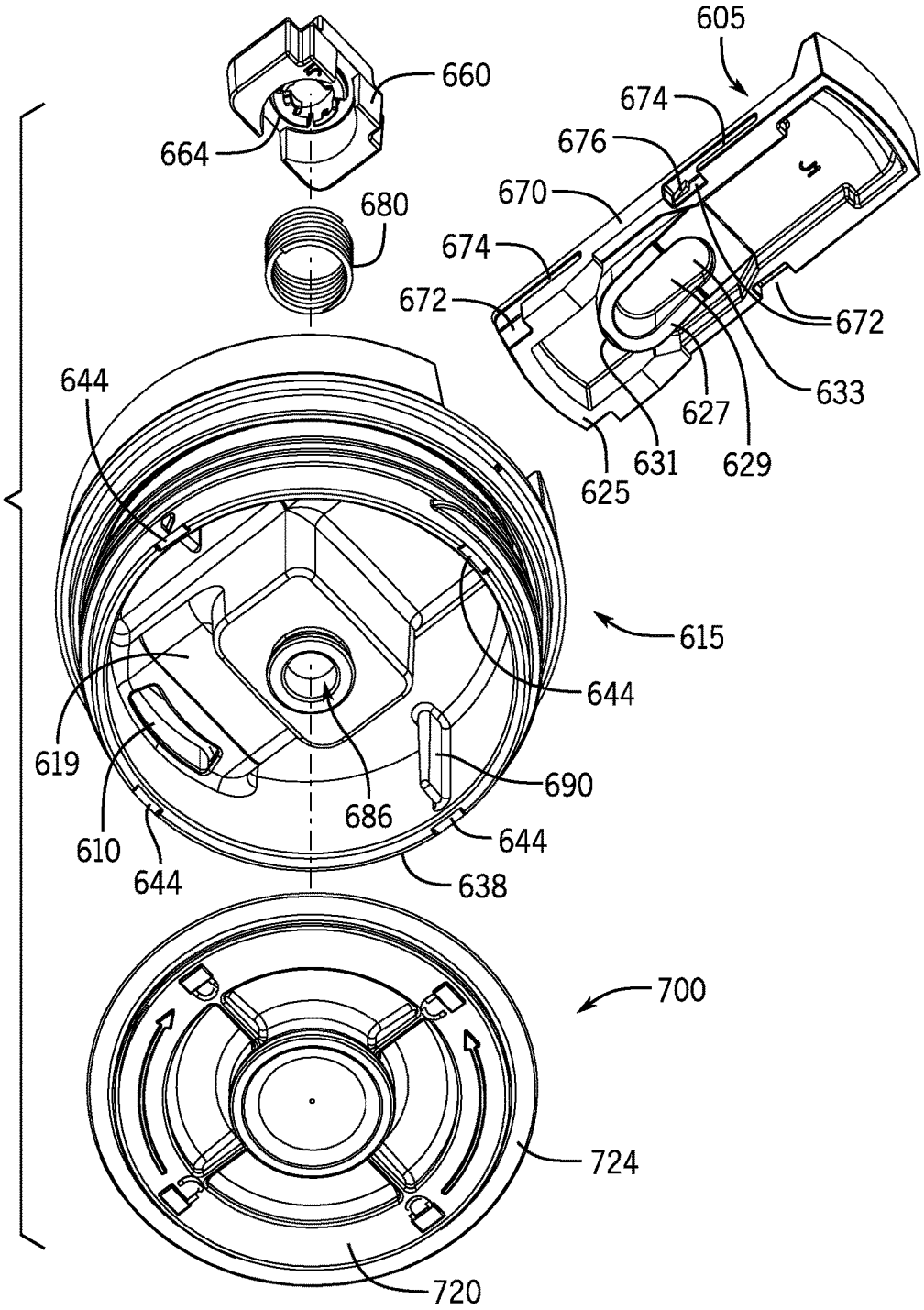
FIG. 19 is an exploded lower view of the lid assembly of the second beverage container assembly.

With reference to FIG. 19, the actuator 605 further includes a lower surface 625 forming a lower sloping surface 627. The lower surface 625 further includes a channel 629. The channel 629 includes a first channel end 631 and a second channel end 633. When the actuator 605 slides relative to the lid body 615, the lower sloping surface 627 urges against an upper sloping surface 662 of the stem retainer 660 to open the valve assembly 620 by pushing the valve assembly downward. As described below, the first channel end 631 and the second channel end 633 provide a limit to the sliding movement of the actuator 605.

Figure 23:
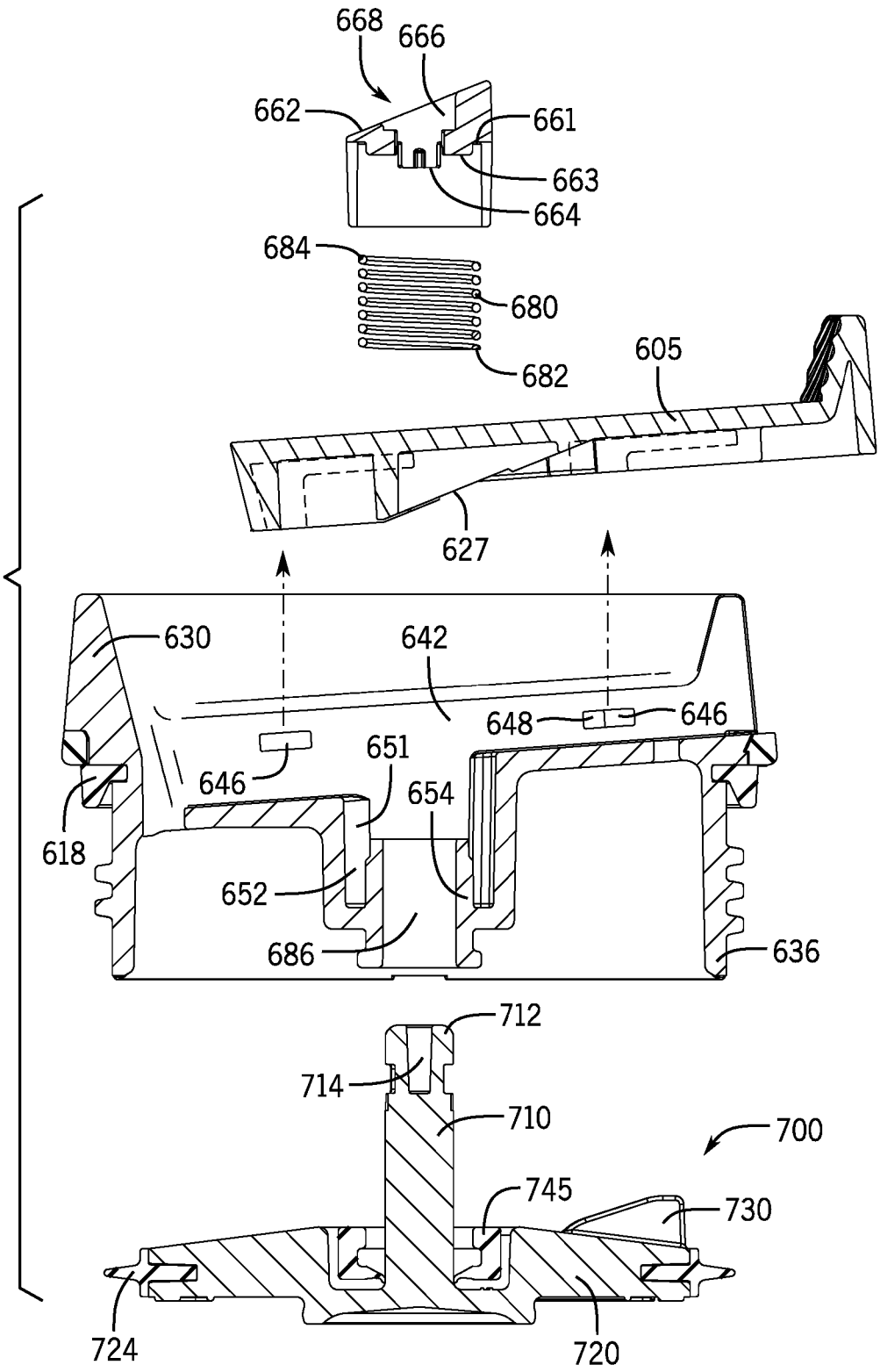
FIG. 23 is an exploded view of the valve assembly of the second beverage container assembly.

The valve assembly 620 will now be described with reference to FIG. 23. The valve assembly 620 includes a valve body 700. The valve body 700 includes a valve stem 710 extending from a valve body plate 720. The valve stem 710 may extend generally perpendicular to the valve body plate 720. In certain aspects, the valve stem 710 may be integrally molded to the valve body plate 720. In alternative aspects, the valve stem 710 and the valve body plate 720 may be two separate pieces with some connection structure known in the art. In yet additional aspects, a stem retainer could have a descending stem that is integrally molded therewith, and the valve body plate (a separate piece) could be removably connected by any appropriate connection structure known in the art.

A valve body plate gasket 724 may be positioned around a perimeter of the valve body plate 720. The valve body plate 720 may include one or more ridges 730 that extend upward from the valve body plate 720. As shown in FIGS. 18 and 19, the ridges 730 generally meet with protrusions 690 and help to prevent the rotation of the of the valve body 700. In this aspect, the valve body 700 is not intended to be removable from the lid body 615. If a user attempts to twist the valve body 700 relative to the lid body 615, the engagement of the ridges 730 with the with protrusions 690 may prevent such movement. The protrusions 690 extend from an inner surface of the lower outer wall 635 of the lid body 615 to reduce any rotation of the valve body 700. In this aspect, the ridges 730 are provided at 90 degree intervals on the valve body plate 740, with opposite ridges 730 positioned in a slightly offset manner to engage the protrusions 690. In this aspect, four ridges 730 extend upward from the valve body plate 720. In other aspects, fewer or additional ridges 730 may be provided at differing intervals.

The valve stem 710 passes through the central passage 686 of the lid body 615 and into the stem retainer 660 in the cavity 650 and engages with the stem retainer 660. An upper end 712 of the valve stem 710 includes an engaging member 714 that lockingly engages with an engaging member 664 of the stem retainer 660. The engaging member 664 may be positioned in or formed on an inner opening surface 666 of the opening 668 of the stem retainer 660. In this aspect, the engaging members 664 and 714 may include complementary components of a locking engagement that is not intended to be readily separable.

In operation, the valve body 700 is positioned beneath the lid body 615. The valve stem 710 passes through a shaft gasket 745 and through the central passage 686 of the guide member 654. The upper end 712 of the valve stem 710 locks with the stem retainer 660. A biasing member 680 urges the valve body 700 to a closed position that reduces leakage of the beverage container assembly 11 when the actuator 605 is in the closed position. The biasing member 680 may include a coil spring, magnet pair, or other biasing member or spring. In certain aspects, the biasing member 680 urges the valve body 700 upward to the closed position.

Figure 22:
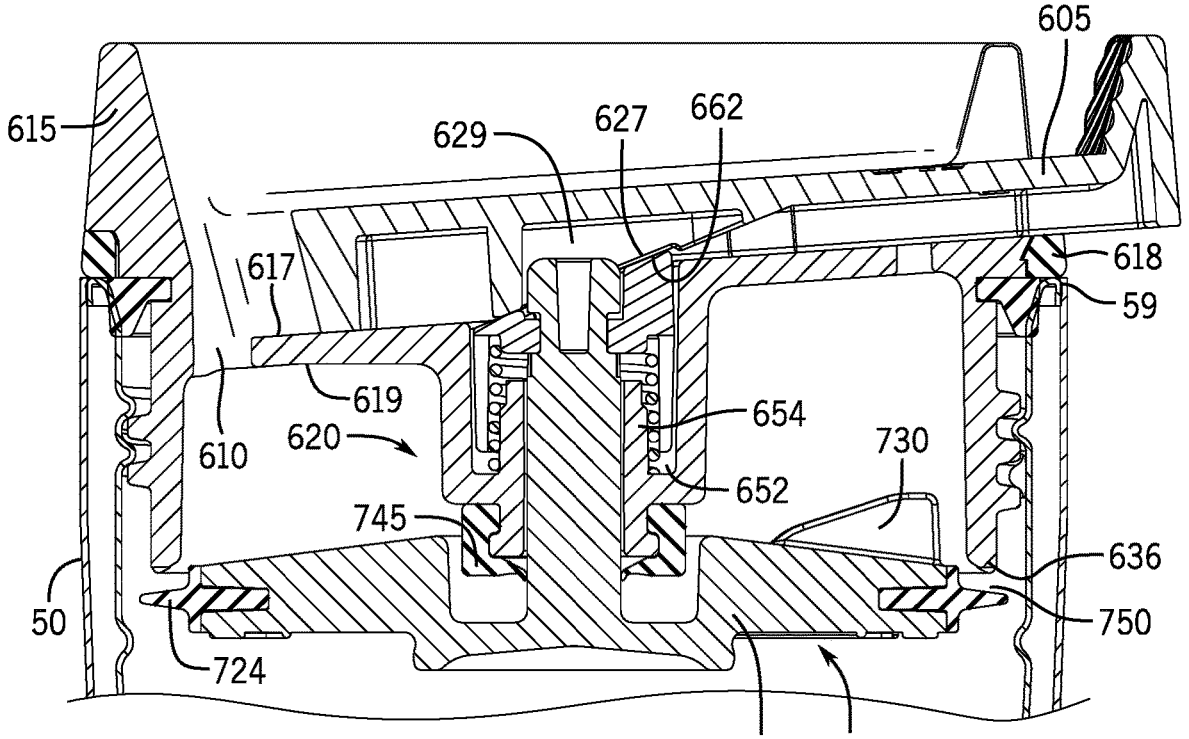
FIG. 22 is a sectional view of lid assembly of the second beverage container assembly with the actuator moved to the open position.

In FIG. 21, the valve assembly 620 is closed as the valve body 700 is urged against the lower end 636 of the lower outer wall 635 of the lid body 615. In FIG. 22, a fluid passage 750 is open as the lid body 615 is moved downward to form a gap for fluid travel between a valve body plate gasket 724 and the lower end 636 of the lower outer wall 635 of the lid body 615.

As shown in FIGS. 21 and 22, the fluid passage 750 is opened and closed by moving the valve body 700. The fluid passage 750 is formed between the valve body plate gasket 724 and the lower end 636 of the lower outer wall 635 of the lid body 615. In the closed position, the valve body plate gasket 724 may rub or seal against one or both of the lower end 636 and the inner wall 58 of the beverage container 50. When the valve body 700 is moved downward by the actuator 605 moving to the open position, the fluid passage 750 is opened. When the actuator 605 is moved to the closed position, the biasing member 680 urges the valve body 700 upward to a closed position, which closes the fluid passage 750 to reduce unwanted spillage or leakage of liquid from the beverage container 50.

A fluid contained in the beverage container assembly 11 generally has to pass through the fluid passage 750 before the fluid can reach the dispensing opening 610. The flow of the fluid through the fluid passage 750 is controlled by the valve body 700 and, in certain aspects, the flow of the fluid through the dispensing opening 610 is controlled by the actuator 605. Thus, the lid assembly 600 of the beverage container assembly 11 provides multiple checks or measures to stop unwanted spillage or leakage of liquid from the beverage container 50.

In this aspect, a lower end 682 of the biasing member 680 urges against the lower interior surface 652 of the cavity 650. The biasing member 680 may be fit over the guide member 654 of the cavity 650 and the valve stem 710 may pass through an interior of the biasing member 680. An upper end 684 of the biasing member 680 may urge against the groove 661 formed in a lower surface 663 of the stem retainer 660, which drives the stem retainer 660 upward.

When the actuator 605, configured as a sliding member embodiment, is slidably moved relative to the lid body 615, the upper end 712 of the valve stem 710 is positioned in the channel 629 of the lower surface 625 of the actuator 605. A length of the channel 627 limits an amount of movement of the actuator 605. The actuator 605 may move laterally until a side surface of the upper end 712 of the valve stem 710 contacts the first channel end 631 or the second channel end 633 of the channel 629.

When the actuator 605 moves to the open position, the lower sloping surface 627 of the actuator 605 is urged against the upper sloping surface 662 of the stem retainer 660. The engagement of the lower sloping surface 627 and the upper sloping surface 662 is shown in FIGS. 21 and 22. This engagement drives the stem retainer 660 in a downward direction (overcoming the bias of the biasing member 680) and likewise drives the valve stem 710 downward to open up the fluid passage 750. In the aspect of FIGS. 21 and 22, the actuator 605 is moving to the right side to be in the open position. As the actuator 605 moves to the right, the larger section of the lower sloping surface 627 presses against the larger section upper sloping surface 662. The engagement of the lower sloping surface 627 pressing against the upper sloping surface 662 converts the generally lateral movement of the actuator 605 to the downward movement of the stem retainer 660. The lower sloping surface 627 and the upper sloping surface 662 form two interacting wedges or ramps that translate the opening movement of the actuator 605 to further open the valve assembly 620.

During the opening movement of the actuator 605 as illustrated, the actuator 605 is held to the lid body 615 by the engagement of the protrusions 646 of the indentation sidewalls 642 of the lid body 615 with the bayonet opening 672 and bayonet channel 674 of the sidewall 670 of the actuator 605. The force from the engagement of the lower sloping surface 627 pressing against the upper sloping surface 662 is released downward. Thus, the generally lateral movement of the actuator 605 urges the valve body 700 downward.

Figure 20:
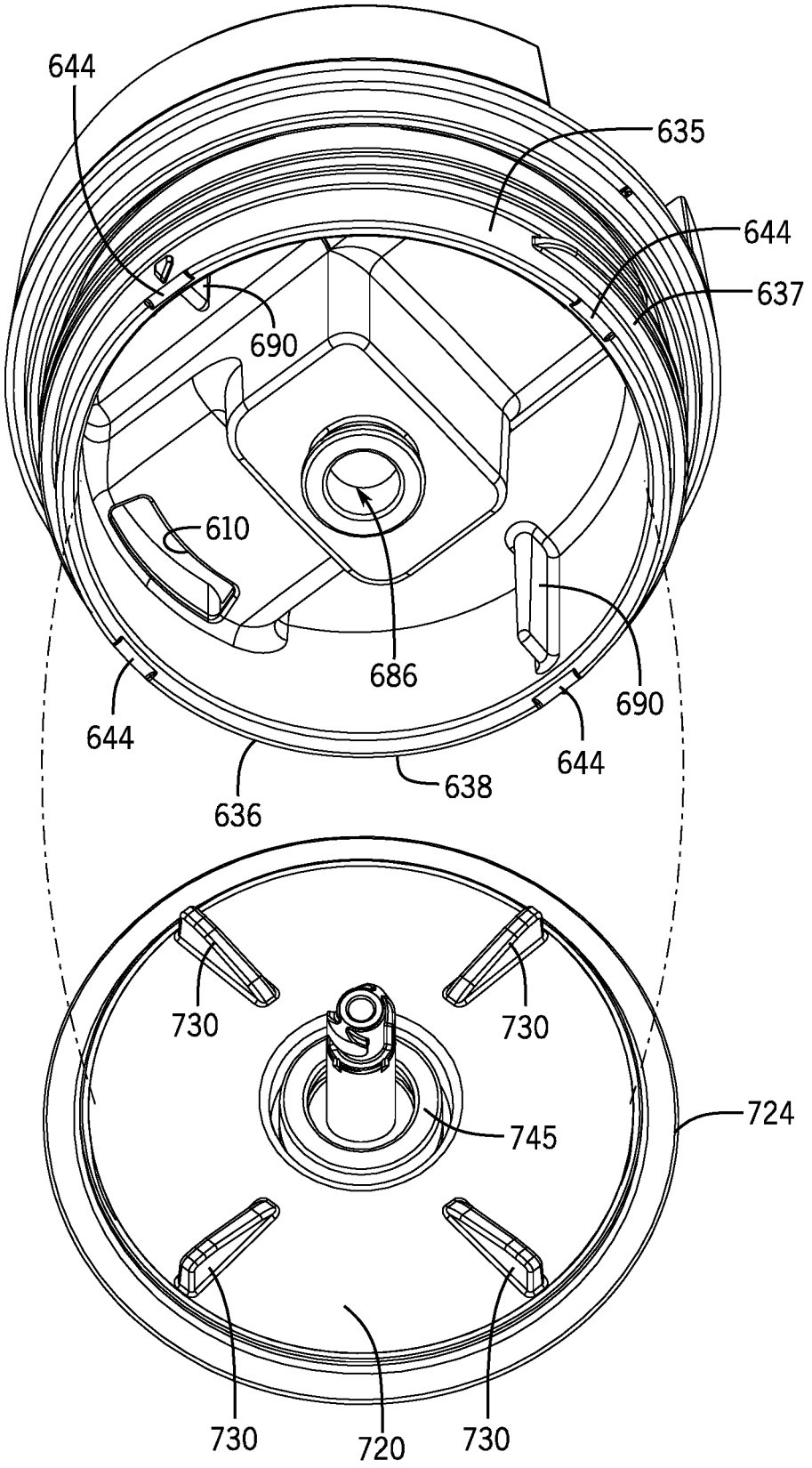
FIG. 20 is an exploded lower view of the lid assembly of the second beverage container assembly.

In some aspects, such as shown in FIG. 20, a lower end 636 of the lower outer wall 635 of the lid body 615 is formed with a generally contiguous surface 638 having one or more breaks 644 in the contiguous surface 638. As the valve assembly 620 is opened, the breaks 644 assist in breaking or loosening a seal between the valve body plate gasket 724 and the lower end 636 of the lower outer wall 635. The warming and/or the latent heat of a beverage contained in the beverage container 50 may place pressure on the valve body plate gasket 724 and urge or bias the valve body plate gasket 724 against the lower end 636 of the lower outer wall 635. The pressure on the valve body plate gasket 724 may make it difficult or hinder the opening of the valve assembly 620. The breaks 644 may make it easier for the valve assembly 620 to open by relieving the pressure. In general, the pressure from the beverage in the container 50 is urging or biasing against a lower surface of the valve body plate gasket 724 in a generally upward direction, which is generally opposite of the opening direction of the valve body plate gasket 724, which moves downward to open the valve assembly 620. The breaks 644 may include recesses, notches, or other venting structures in the lower outer wall 635 of the lid body 615. The pressure from the beverage contained in the beverage container 50 forces the valve body plate gasket 724 to conform to the generally contiguous surface 638 of the lower outer wall 635 of the lid body 615. When the valve body 700 is moved downward to open, the valve body plate gasket 724 may roll away from or withdraw from the generally contiguous surface 638 in order to break the seal between the valve body plate gasket 724 and the lower outer wall 635. The breaks 644 provide venting to make it easier to break the seal.

In the aspect shown, the generally contiguous surface 638 include four of the breaks 644 that are evenly spaced around the lower end 636. Of course, one of ordinary skill may include fewer or additional breaks that are spaced evenly or spaced at varying intervals about the lower end 636.

In operation, as the valve body 700 is urged downward, the breaks 644 provide for venting to break or loosen the seal between the valve body plate gasket 724 and the lower end 636 the lower outer wall 635. Pressure may pass through the venting formed by the breaks 644 before the fluid passage 750 is opened. By relieving the pressure through the breaks 644, the valve body 700 may become easier to move downward to the open position.

In some aspects, such as shown in FIG. 18, the stem retainer 660 may include corners 692 having a cut-out 694 or include a recess that cooperate with or are complementary to protrusions 656 or a projecting member that protrudes or extends from the walls forming the cavity 650. In this aspect, the corners 692 are generally opposite of a lateral surface 669, which is generally flat. When the stem retainer 660 is properly aligned with the cavity 650, the cut-outs 446 will fit over the protrusions 656 and the stem retainer 660 will insert into the cavity 650. When the stem retainer 660 is not properly aligned with the cavity 650, the stem retainer 660 will not fit into the cavity 650 as the lateral surface 669 will contact the protrusions 656, and the protrusions 656 will physically block the stem retainer 660 from properly fitting into the cavity 650. In this aspect, two corners 692 include the cut-outs 694. In other aspects, fewer or additional corners 692 may include cooperating or complementary shapes that interact with the walls of the cavity 650. Further, the relative positions of the lateral surface 669 and the cut-outs 694 may be reversed.

A lid assembly 800 and a beverage container assembly 12 will now be described with reference to FIGS. 24-42. The lid assembly 800 generally operates in a similar manner to the lid assemblies 100 and 600, i.e., an actuator 805 is moved by the user to open and close a dispensing opening 820 and to also open and close a valve assembly 810. However, in this aspect, a spring is not used. Instead, the actuator 805 includes biasing or closing structures that contact portions of the lid assembly 800 to provide closing forces to the valve assembly 810. Further, the lid assembly 800 may be disassembled for cleaning.

The lid assembly 800 includes the actuator 805 that opens and closes the dispensing opening 820 of the lid assembly 800 and also actuates the valve assembly 810 of the lid assembly 800. The actuator 805 moves to uncover or open the dispensing opening 820 while simultaneously opening the valve assembly 810. A lower surface 825 of the actuator 805 blocks or covers the dispensing opening 820. The valve assembly 810 provides extra protection against the beverage container assembly 12 from leaking when the actuator 805 is in a closed position covering up the dispensing opening 820. In other aspects, the actuator 805 merely opens and closes the valve assembly 810, and does not also block or cover the dispensing opening 820.

The actuator 805 may be a sliding member, a twisting member, a magnetic assembly, a lever member, a button member, or other element known in the art. Depending on the embodiment, the user may push, pull, slide, twist, turn, move, or otherwise actuate the actuator 805 to open the valve assembly 810 and/or cover the dispensing opening 820.

The actuator 805 configured as a sliding member may move in a generally lateral direction to uncover or open the dispensing opening 820 while simultaneously opening the valve assembly 810. The actuator 805 may move generally perpendicular to a vertical axis of the beverage container 50 when the lid assembly 800 is engaged with the beverage container 50. When fully moved to its maximum extent, a portion of the actuator 805 may extend beyond a rim 830 of the lid body 815 of the lid assembly 800. In the opening movement of the actuator 805, the actuator 805 is moving outward from a center of the lid body 815 and toward the rim 830. In other aspects, a sliding member version of an actuator 805 merely slides in an indentation that is smaller than the circumference of the upper lid surface. Such a version of a sliding member may include a handle to facilitate the user moving such sliding member.

As shown in FIGS. 24-27, the lid assembly 800 includes the lid body 815. The lid body 815 is shaped and configured to close the opening 52 of the beverage container 50. The lid body 815 includes a lower outer wall 835 that forms an engaging member 837 to removably engage with the engaging member 56 of the beverage container 50. In this aspect, the lower outer wall 835 enters the opening 52 of the beverage container 50. The engaging member 837 and the engaging member 56 may include complementary components of a threaded engagement, snap-fit engagement, frictional engagement, bayonet engagement, or other engagements configured to selectively attach the lid body 815 to the beverage container 50.

The lid assembly 800 will now be described with reference to FIGS. 28-31. The lid assembly 800 includes the lid body 815 that includes the dispensing opening 820. The dispensing opening 820 generally extends from an upper surface 817 of the lid body 815, through the lid body 815, and to a lower surface 819 of the lid body 815 to permit liquids to pass therethrough when open. The dispensing opening 820 may be sized or configured differently depending on the intended use of the lid assembly 800. For example, if the lid assembly 800 is intended to be used with a smaller volume beverage container 50 or intended for hot beverages, then the dispensing opening 820 may include a smaller dimensioned opening. For example, if the lid assembly 800 is intended to be used with a larger volume beverage container 50 intended for cold beverages, then the dispensing opening 820 may include a larger dimensioned opening. The upper surface 817 of the lid body 815 may generally slope or angle toward to the dispensing opening 820, which helps drips of fluid to flow back down through the dispensing opening 820.

The lid body 815 includes the actuator 805, configured as a sliding member, in this aspect, to slidably move to open and close the dispensing opening 820. The actuator 805 is movably engaged to the lid body 815. The illustrated lid body 815 includes an indentation 840 in its upper surface 817 that receives the actuator 805 in the movable engagement. The indentation 840 includes indentation sidewalls 842 having protrusions 846 that removably engage with the actuator 805. A bottom surface 845 of the indentation 840 includes a vent opening 847 to vent an interior of the beverage container 50 when the lid assembly 800 is engaged to the beverage container 50. The vent opening 847 runs through the entire bottom surface 845 to permit release of air or gas therethrough.

Figure 25:
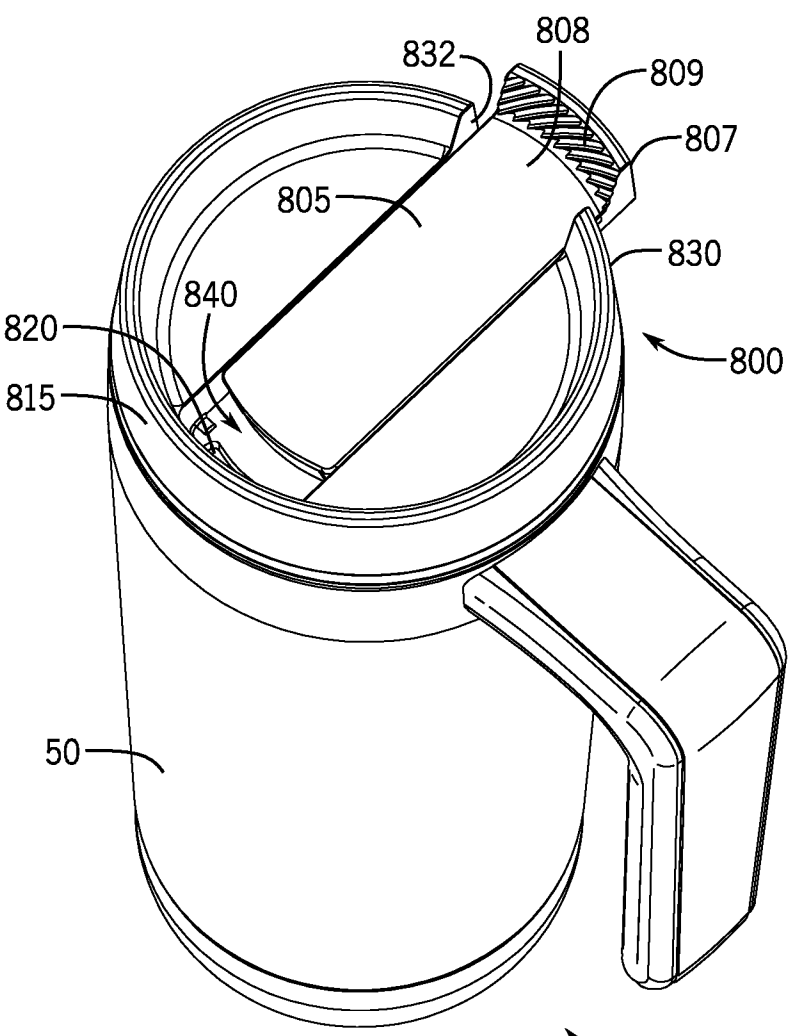
FIG. 25 is a perspective view of the third beverage container assembly with the actuator moved to the open position.
Figure 24:
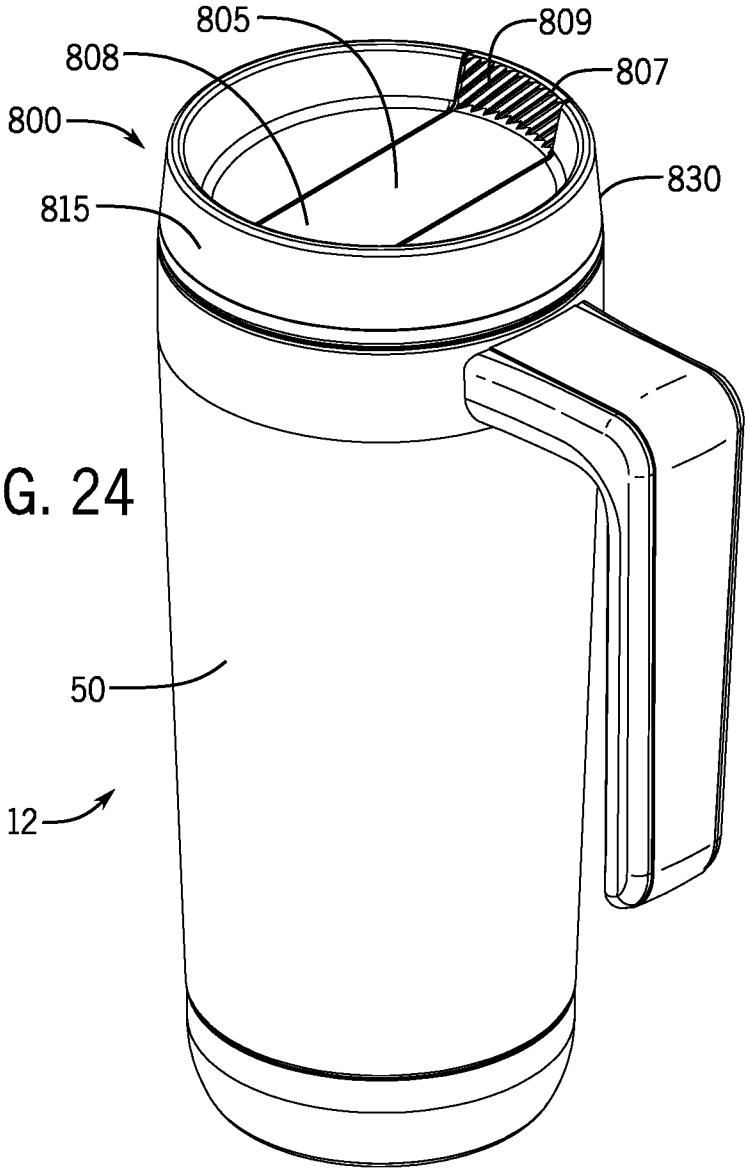
FIG. 24 is a perspective view of the third beverage container assembly.
Figure 26:
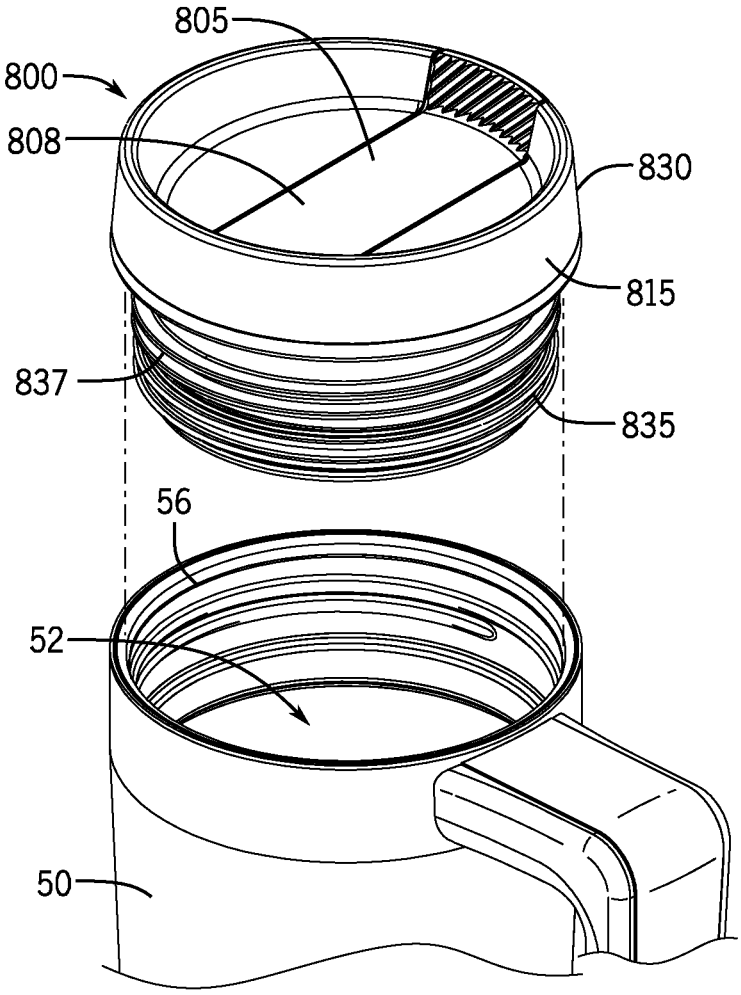
FIG. 26 is an exploded view of the third beverage container assembly.
Figure 27:
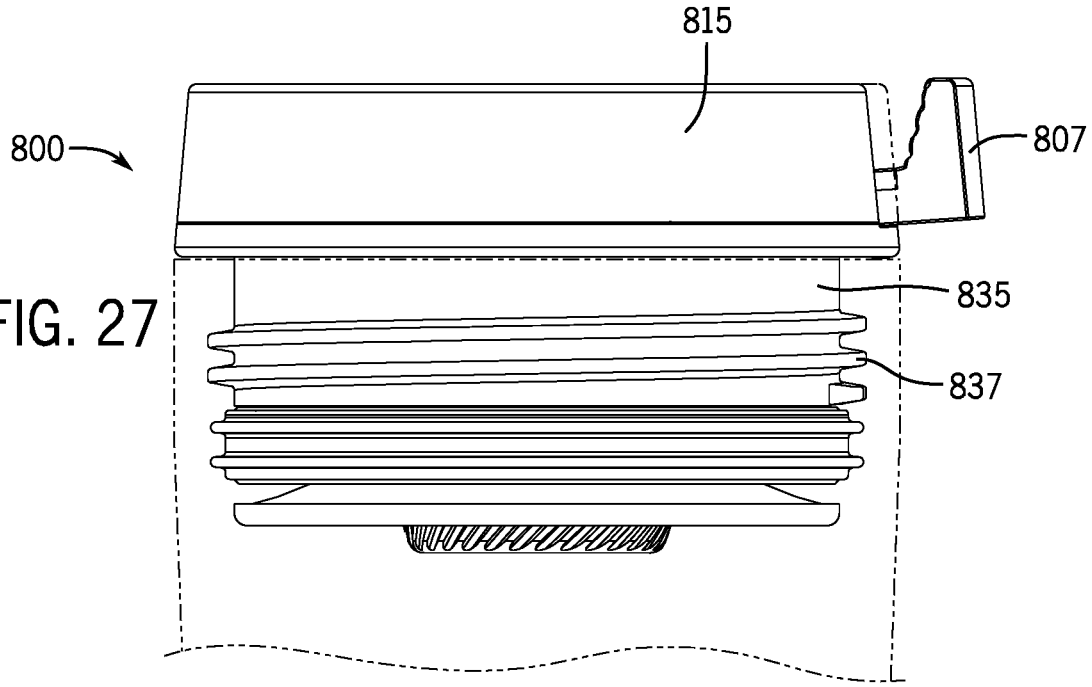
FIG. 27 is a side view of the lid assembly of the third beverage container assembly.
Figure 28:
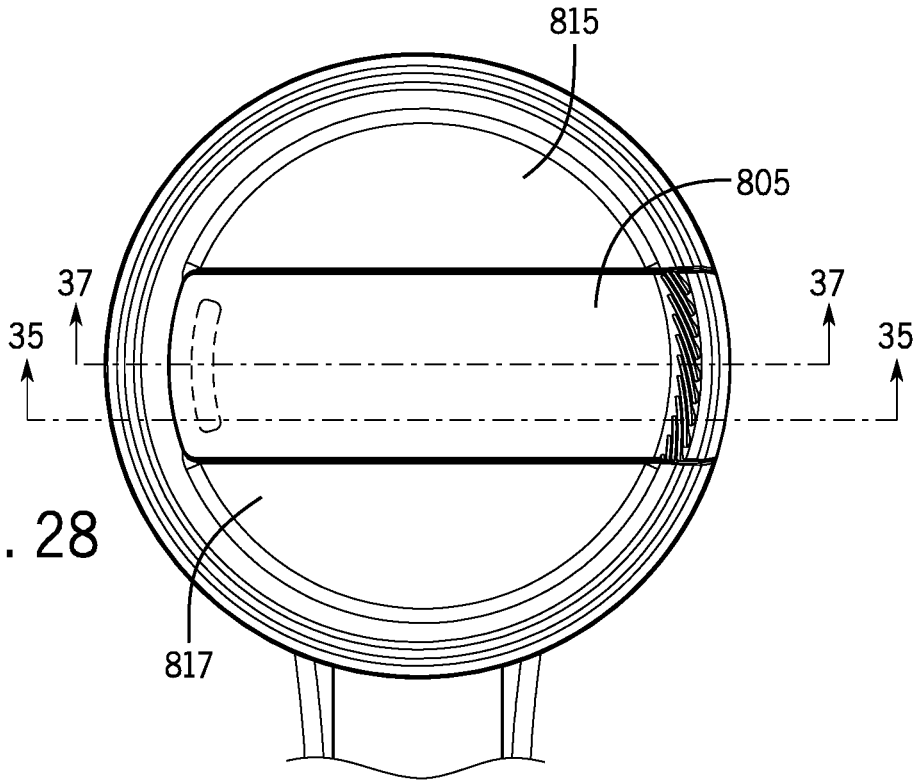
FIG. 28 is a top view of the third beverage container assembly.
Figure 29:
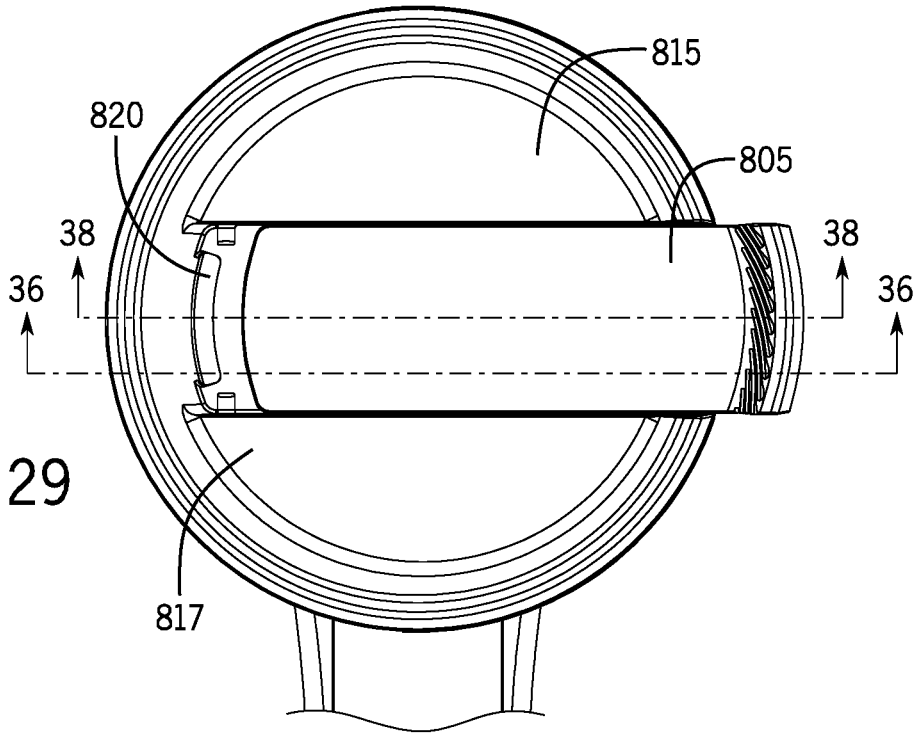
FIG. 29 is a top view of the third beverage container assembly with the actuator moved to the open position.

As shown in FIG. 25, the lid body 815 further includes the rim 830 having a rim opening 832. The actuator 805 may slide or pass through the rim opening 832 when the actuator 805 is moved to the open position. The rim opening 832 is sized to permit the actuator 805 or a portion thereof to pass through the rim opening 832. In certain aspects, the actuator 805 includes a tab 807 that extends upward from an upper surface 808 of the actuator 805. An inner portion of the tab 807 may include a textured grip 809. The tab 807 is sized and shaped to permit a user to push or hold to move the actuator 805 to an open position or a closed position.

Figure 30:
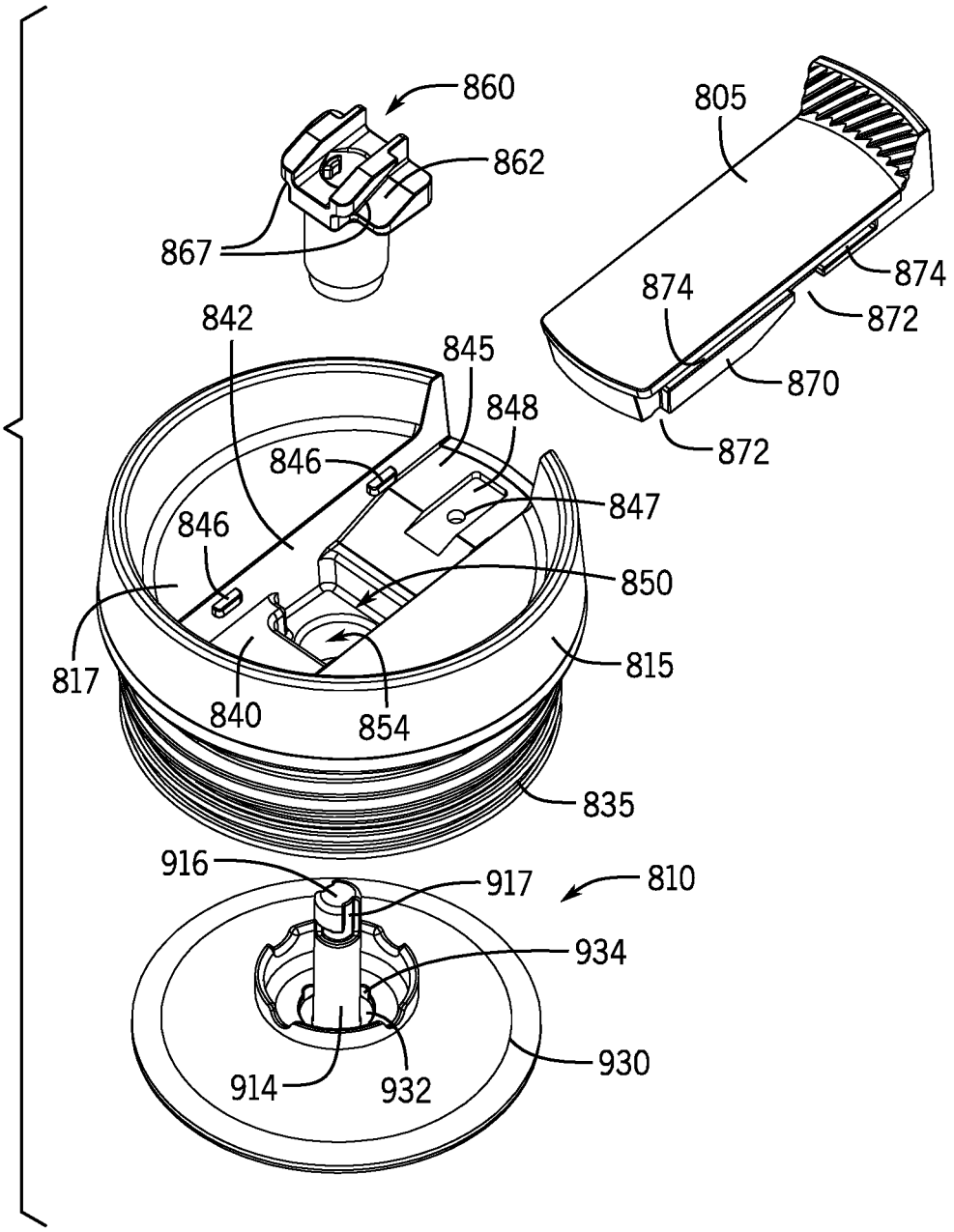
FIG. 30 is an exploded upper view of the lid assembly of the third container assembly.

As shown in FIG. 30, the lid body 815 further includes a cavity 850. The lid body 815 includes descending walls 852 that extend below the bottom surface 845 to form the cavity 850. The cavity 850 is sized and shaped to receive the stem retainer 860. The cavity 850 defines a central passage 854, which passes through the lid body 815.

In certain aspects, the body of the actuator 805 includes sidewalls 870 having an opening 872, which leads to a channel 874. As illustrated, some aspects of the actuator 805 include multiple openings 872 and respective channels 874 (possibly just one or two or more on each sidewall 870). When the actuator 805 is engaged to the lid body 815, the protrusions 846 of the indentation sidewalls 842 enter into the opening 872 of the sidewalls 870 to slidably lock the actuator 805 to the lid body 815. As the actuator 805 slides relative to the lid body 815, the protrusions 846 pass from the openings 872 into the channels 874, which provide a length of travel for the protrusions 846.

Figure 31:
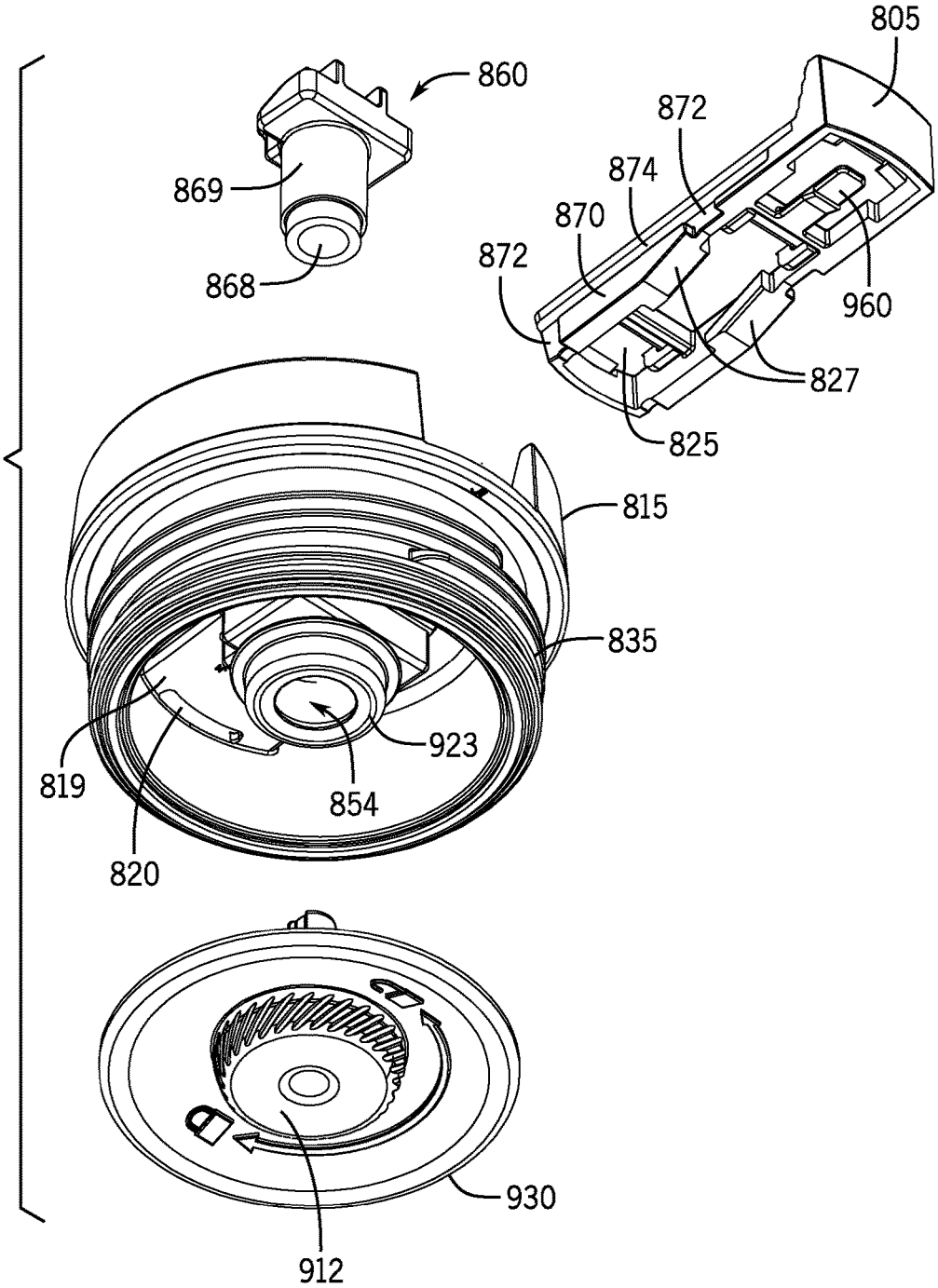
FIG. 31 is an exploded lower view of the lid assembly of the third beverage container assembly.
Figure 32:
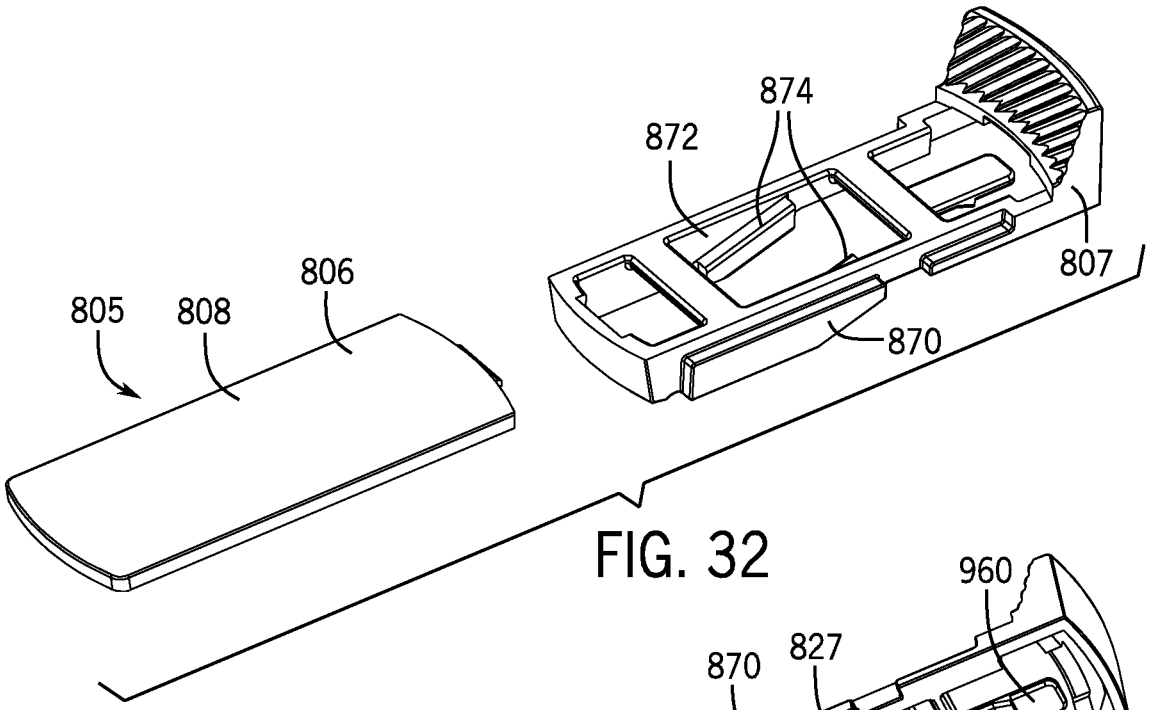
FIG. 32 is an exploded upper view of the actuator of the third beverage container assembly.
Figure 33:
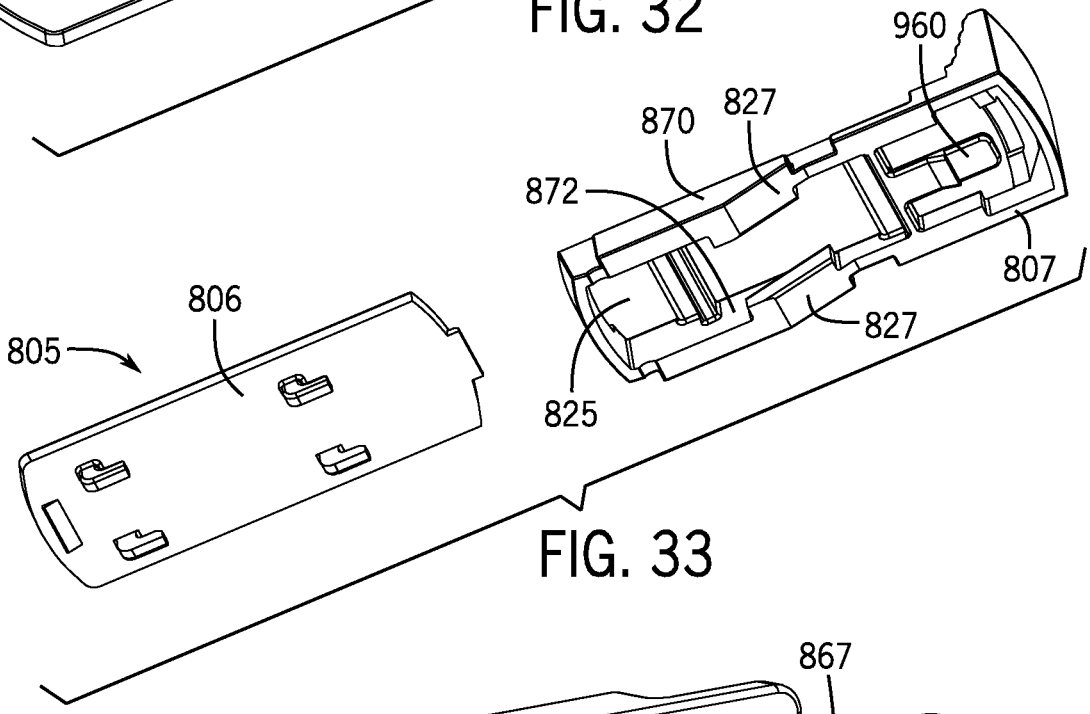
FIG. 33 is an exploded lower view of the actuator of the third beverage container assembly.
Figure 34:
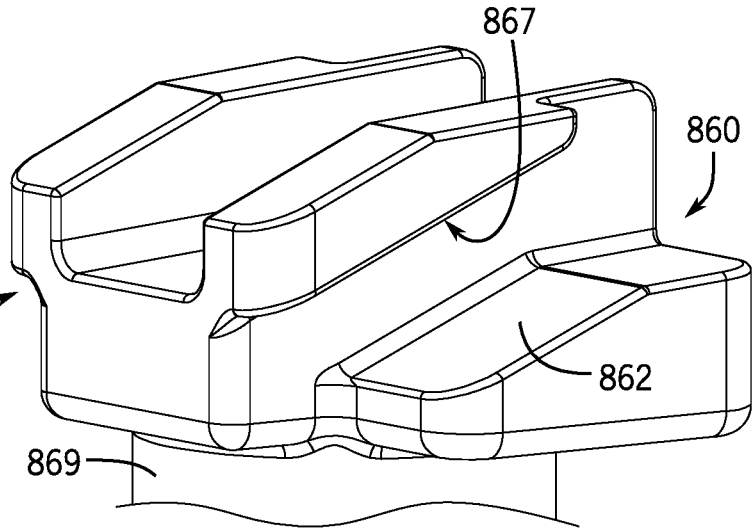
FIG. 34 is a perspective view of the stem retainer of the third beverage container assembly
Figure 35:
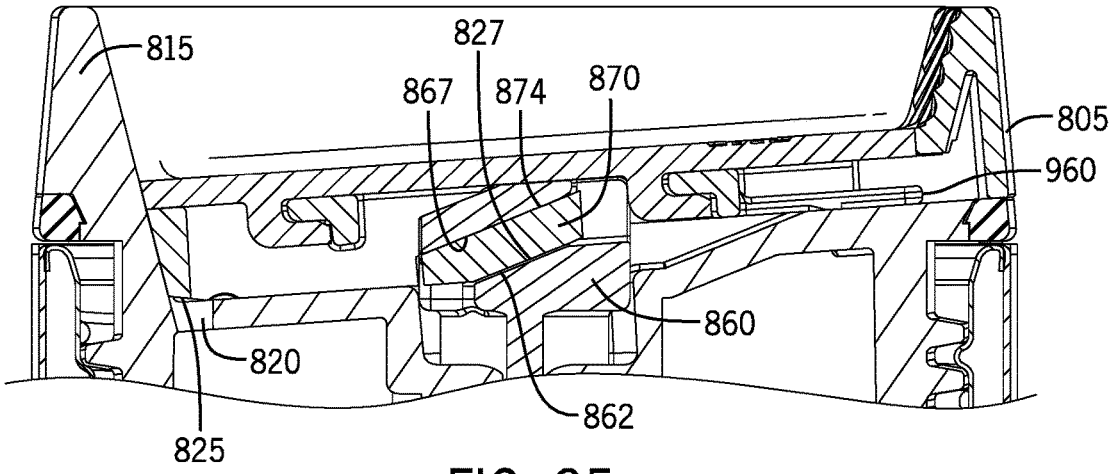
FIG. 35 is a sectional view of the lid assembly of the third beverage container assembly with the actuator in the closed position.
Figure 36:
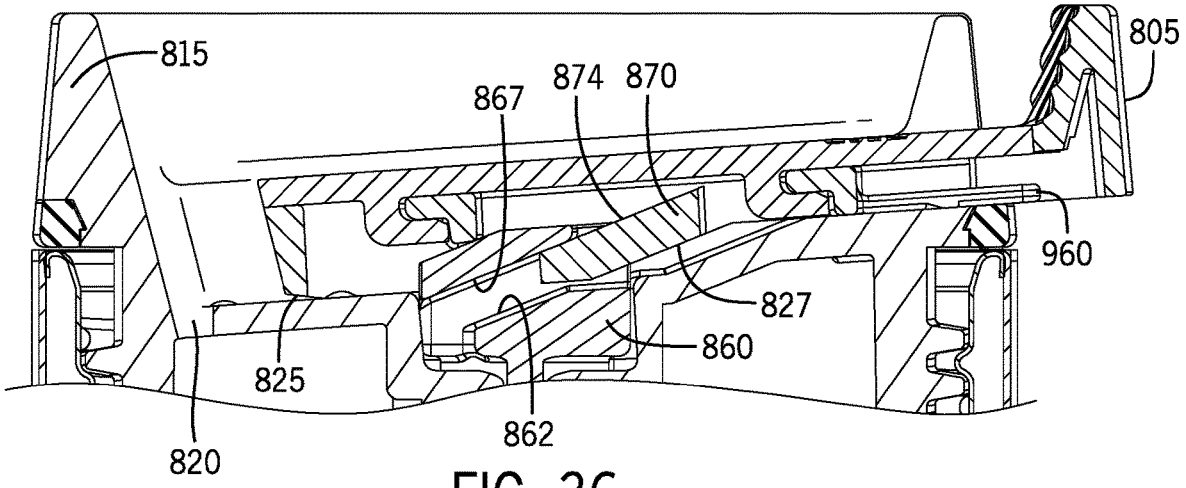
FIG. 36 is a sectional view of lid assembly of the third beverage container assembly with the actuator moved to the open position.

In this aspect, the actuator 805 and/or the stem retainer 860 include ramps, inclines, angled surfaces, etc. that urge the valve assembly 810 to an open position when the actuator 805 is moved. As shown in FIG. 31, the sidewalls 870 of the actuator 805 include lower sloping surfaces 827. As shown in FIG. 34, the stem retainer 860 includes upper sloping surfaces 862. When the actuator 805 slides relative to the lid body 815 as shown in FIGS. 35 and 36, the lower sloping surfaces 827 of the actuator 805 urge or slide against the upper sloping surfaces 862 of the stem retainer 860 to drive or urge the valve stem 914 downward to open the valve assembly 810. In this aspect, the lower sloping surfaces 827 of the actuator 805 slide over the upper sloping surfaces 862. Also, as shown in FIGS. 32 and 33, in certain aspects, the actuator 805 may include an upper portion 806 and a lower portion 807.

In this aspect, the engagement between the actuator 805 and the lid body 815 in the closed position also provides a bias or urges the valve assembly 810 to a closed position. The actuator 805 and/or the lid body 815 include ramps, inclines, angled surfaces, etc. that drive or urge the valve assembly 810 to the closed position. As shown in FIG. 34, the stem retainer 860 includes lower sloping surfaces 867. In this aspect, as shown in FIG. 33, internal surfaces 872 of the sidewalls 870 of the actuator 805 include incline surfaces 874 that slide against the lower sloping surfaces 867 when the actuator 805 is moved to the closed position to urge the valve body 900 upward to the closed position. In this aspect, the incline surfaces 874 slide under the lower sloping surfaces 867. The sliding contact between the incline surfaces 874 and the lower sloping surfaces 867 thus drives the valve assembly 810 upward to the closed position. This engagement reduces leakage of the beverage container assembly 10 when the actuator 805 is in the closed position.

The valve assembly 810 will now be described with reference to FIG. 42. The valve assembly 810 includes a valve body 900. In this aspect, the valve body 900 generally includes a two-piece construction. The valve body 900 includes a valve retainer 910 that positions a valve disc 930. The valve disc 930 is moved upward to contact a lid gasket 940 in order to close the valve assembly 810. The lid gasket 940 may be positioned around a perimeter of the lid body 815. The valve disc 930 is moved downward away from the lid gasket 940 in order to open the valve assembly 810 and to form a fluid passage 950.

The valve retainer 910 includes a lower portion 912 that is integral with a valve stem 914. The lower portion 912 is generally perpendicular to the valve stem 914. The lower portion 912 forms a knob-like structure for the user to grip and rotate in order to disassemble the valve body 900. The valve stem 914 passes through a central opening 932 of the valve disc 930. The valve stem 914 removably engages with the stem retainer 860. An interior surface of the lower portion 912 may include a vent gasket 915. A lid shaft gasket 923 is positioned around a lower opening 971 of the central passage 854.

Figure 37:
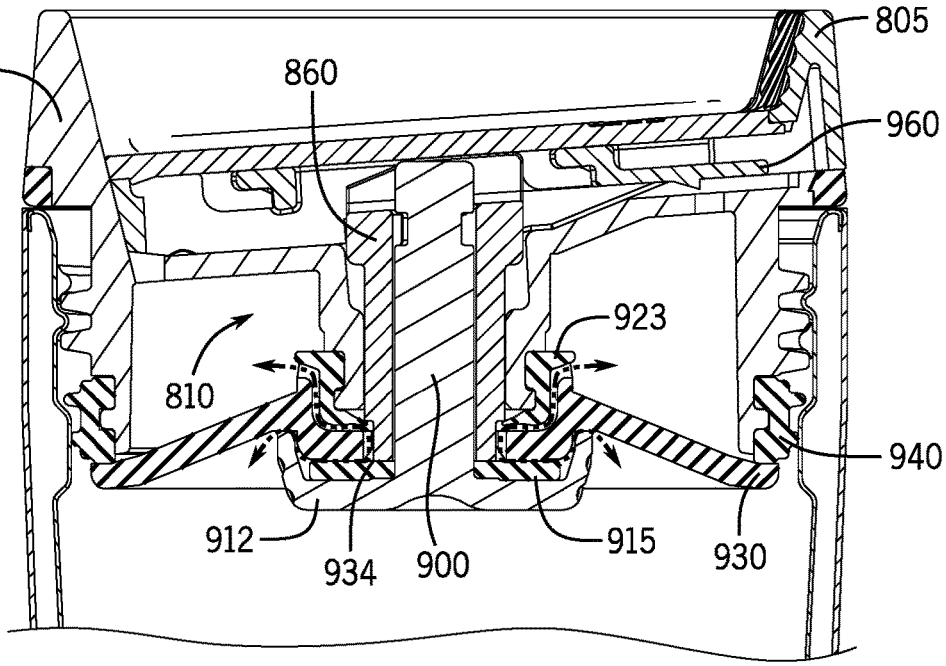
FIG. 37 is a sectional view of the lid assembly of the third beverage container assembly with the actuator in the closed position.

The valve assembly 810 may further provide a vent for the lid assembly 800. As shown in FIG. 37, air or gas may travel along the illustrated vent path to relieve high and/or low pressures within the container 50. The lid shaft gasket 923 covers or partially covers vent passages 934 around the central opening 932 of the valve disc 930. When pressure inside the closed container 50 is sufficiently high, air or gas may pass from the container 50 between the valve disc 930 and the lower portion 912, between the vent gasket 915 and the valve disc 930, through the vent passages 934, and between the lid shaft gasket 923 and the valve disc 930.

Figure 42:
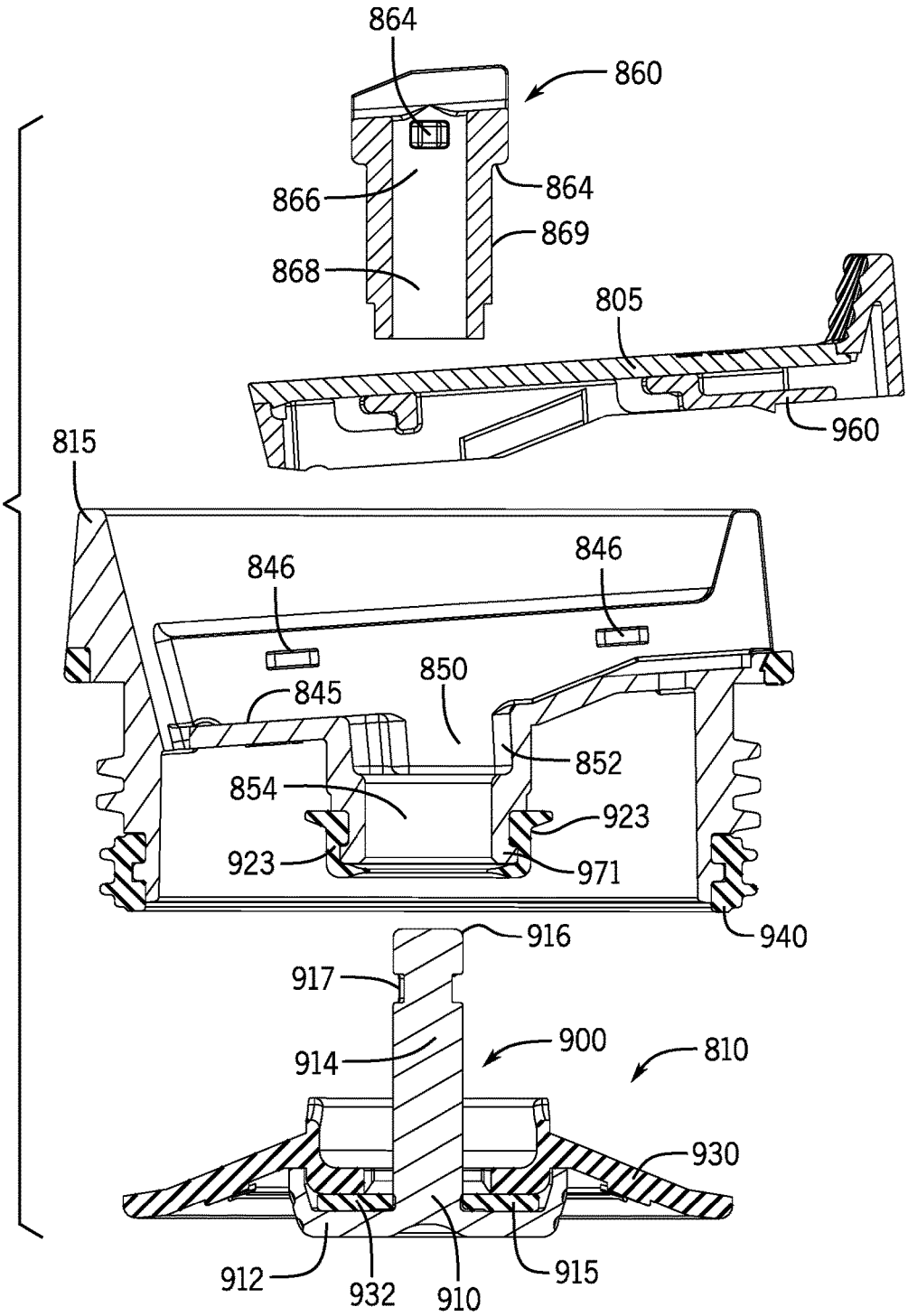
FIG. 42 is an exploded view of the lid assembly of the third beverage container assembly.

With respect to FIG. 42, an upper end 916 of the valve stem 914 removably engages with the stem retainer 860 similar to the aspects of FIGS. 1-11. In this aspect, the stem retainer 860 includes an open shaft 869 that descends from a lower surface 864 of the stem retainer 860. The shaft 869 assists in positioning the valve stem 914.

With respect to FIG. 42, the valve stem 914 passes through the central passage 854 of the lid body 815 and into the stem retainer 860 in the cavity 850 and engages with the stem retainer 860. An upper end 916 of the valve stem 914 includes an engaging member 917 that lockingly engages with an engaging member 864 of the stem retainer 860. The engaging member 864 may be positioned in or formed on an inner opening surface 866 of the opening 868 of the stem retainer 860. The engaging members 917 and 864 may include complementary components of a twist-lock, bayonet, threaded or other removable locking engagement. During disassembly, the valve stem 914 may be removed from the stem retainer 860, for example by twisting and pulling the entire valve body 900, for cleaning purposes.

In operation, the valve body 900 is positioned beneath the lid body 815. The valve stem 914 passes through the lid shaft gasket 923 and through the central passage 854. The upper end 916 of the valve stem 914 removably locks with the stem retainer 860.

Figure 39:
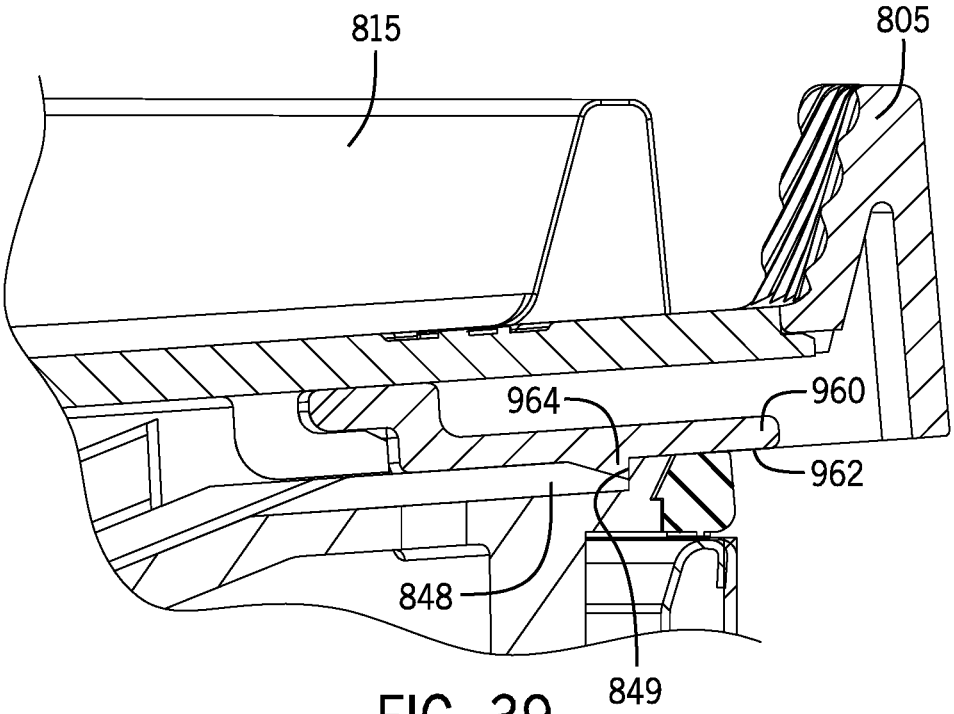
FIG. 39 is a sectional view of the lid assembly of the third beverage container assembly showing the lever.
Figure 40:
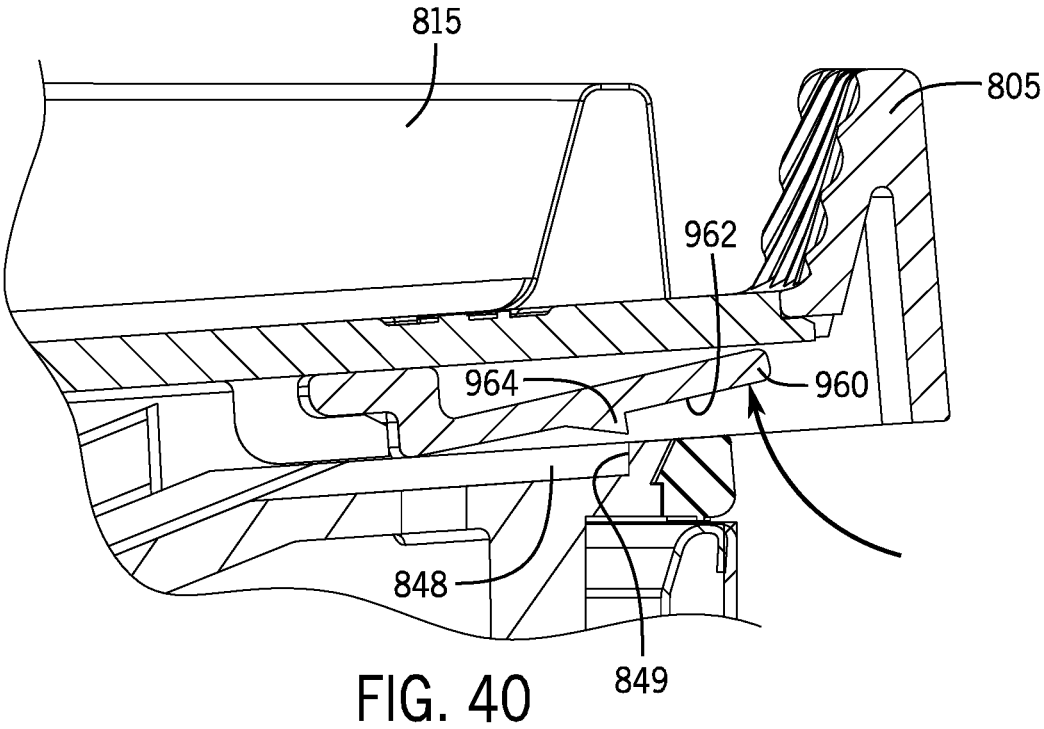
FIG. 40 is a sectional view of the lid assembly of the third beverage container assembly showing the lever.
Figure 41:
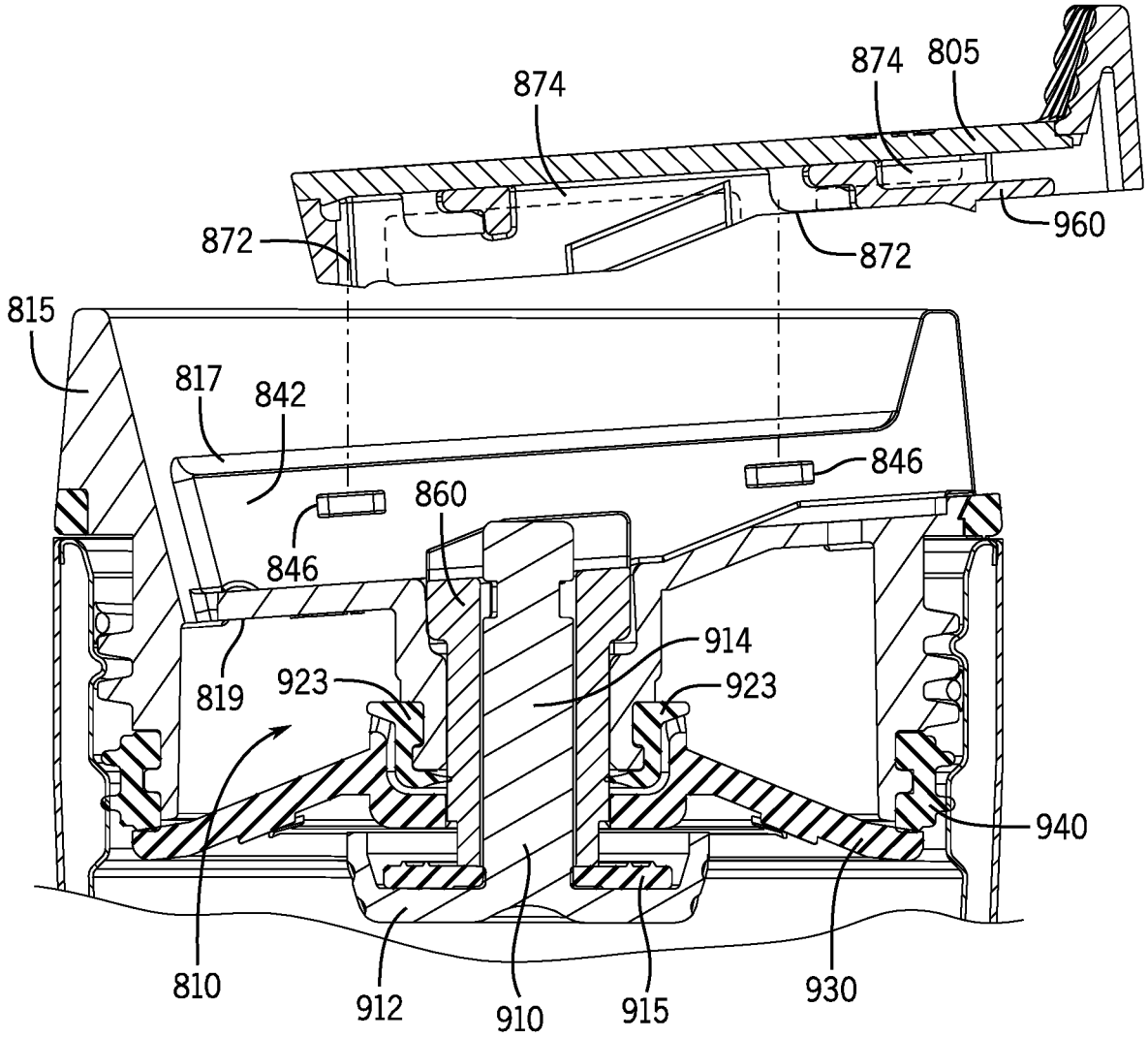
FIG. 41 is a sectional view of the lid assembly of the third beverage container assembly showing the engagement of the actuator to the lid assembly.

As shown in FIGS. 39 and 40, the actuator 805 includes a lever member 960 that provides a catch or stop to prevent the outward movement of actuator 805. The lever member 960 slides in a channel 848 in the bottom surface 845 of the indentation 840. A lower surface 962 of the lever member 960 includes a catch member 964 that catches against an end wall 849 of the channel 848 in the bottom surface 845 of the indentation 840 to stop or prevent further outward movement of the actuator 805. The user may press upward on an underneath surface 962 of the lever member 960 to flex the lever member 960 and lift the catch member 964 over the end wall 849. In order to fully remove the actuator 805, the actuator 805 will need to be disengaged or unlocked from the stem retainer 860.

Figure 38:
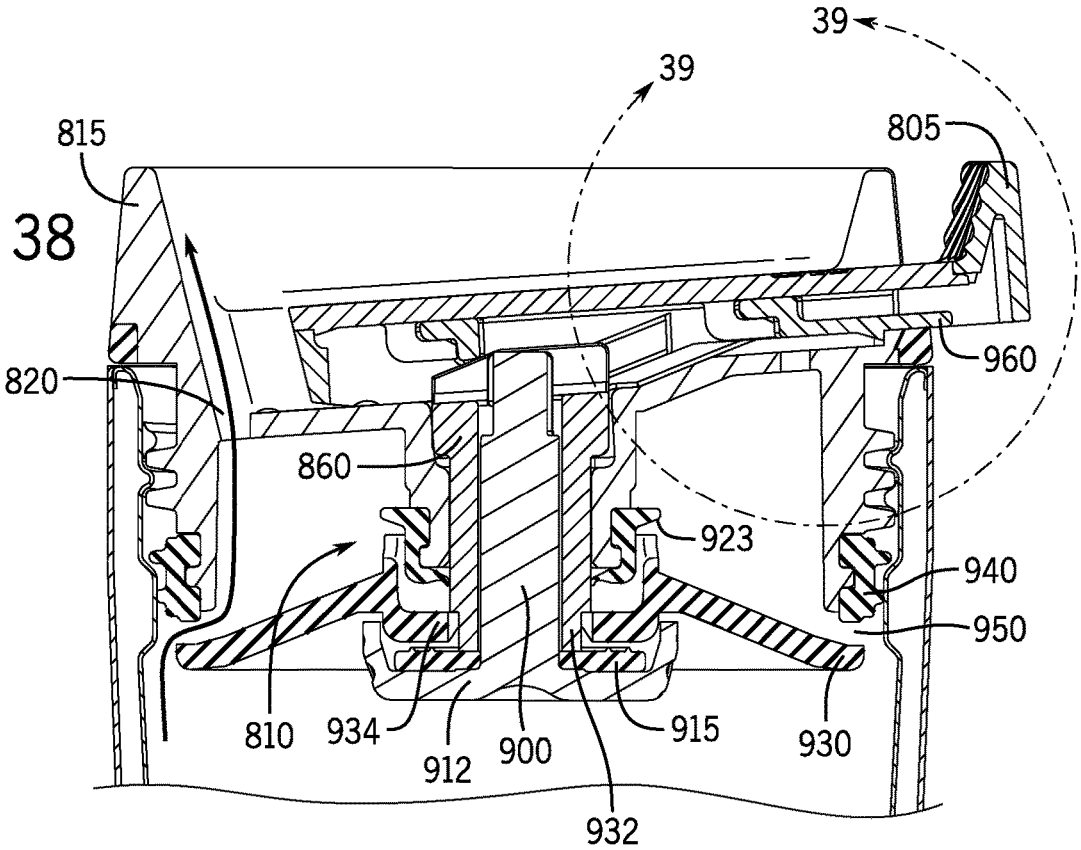
FIG. 38 is a sectional view of lid assembly of the third beverage container assembly with the actuator moved to the open position.

As shown in FIGS. 37 and 38, the valve assembly 810 is closed as the valve body 900 is urged against the lid gasket 940 of the lower outer wall 835 of the lid body 815. In FIG. 38, a fluid passage 950 is opened as the lid body 815 is moved downward to form a gap for fluid travel between the lid gasket 940 and the valve disc 930.

As shown in FIGS. 37 and 38, the fluid passage 950 is opened and closed by moving the valve body 900. The fluid passage 950 is formed between the valve disc 930 and the lid gasket 940 at the lower outer wall 835 of the lid body 815. When the valve body 900 is moved downward by the actuator 805 moving to the open position, the fluid passage 950 is opened. In certain aspects, the sliding engagement of the stem retainer 860 with actuator 805 urges the valve body 900 downward to the open position. In certain aspects, when the actuator 805 is moved to the closed position, the sliding engagement of the stem retainer 860 with the actuator 805 also urges the valve body 900 upward to a closed position, which closes the fluid passage 950 to reduce unwanted spillage or leakage of liquid from the beverage container 50.

A fluid contained in the beverage container assembly 12 generally has to pass through the fluid passage 950 before the fluid can reach the dispensing opening 820. The flow of the fluid through the fluid passage 950 is controlled by the valve body 900 and, in certain aspects, the flow of the fluid through the dispensing opening 820 is controlled by the actuator 805. Thus, the lid assembly 800 of the beverage container assembly 12 provides multiple checks or measures to stop unwanted spillage or leakage of liquid from the beverage container 50.

When the actuator 805 moves to the open position, the lower sloping surfaces 827 of the actuator 805 are urged against the upper sloping surfaces 862 of the stem retainer 860. The engagement of the lower sloping surfaces 827 and the upper sloping surfaces 862 is shown in FIGS. 35 and 36. This engagement drives the stem retainer 860 in a downward direction and likewise drives the valve stem 914 downward to open up the fluid passage 950. In the aspect of FIGS. 35 and 36, the actuator 805 is moving to the right side to be in the open position. The engagement of the lower sloping surfaces 827 pressing against the upper sloping surfaces 862 converts the generally lateral movement of the actuator 805 to the downward movement of the stem retainer 860. The lower sloping surfaces 827 and the upper sloping surfaces 862 form two pairs of interacting wedges or ramps that translate the opening movement of the actuator 805 to further open the valve assembly 810.

During the opening movement of the actuator 805 as illustrated, the actuator 805 is held to the lid body 815 by the engagement of the protrusions 846 of the indentation sidewalls 842 of the lid body 815 with the opening 872 and channel 874 of the sidewall 870 of the actuator 805. The force from the engagement of the lower sloping surfaces 827 pressing against the upper sloping surfaces 862 is released downward. Thus, the generally lateral movement of the actuator 805 urges the valve body 900 downward to open the valve assembly 810.

Similarly, the internal surfaces 872 of the sidewall 870 of the actuator 805 includes the incline surfaces 874 that slide against the lower sloping surfaces 867 of the stem retainer when the actuator 805 is moved to the closed position to urge the valve body 900 upward to the closed position. The sliding contact between the incline surfaces 874 and the lower sloping surfaces 867 drives the valve assembly 810 to a closed position. In this aspect, the incline surfaces 874 and the lower sloping surfaces 867 form two pairs of interacting wedges or ramps that translate the closing movement of the actuator 805 to further close the valve assembly 810. As such, in this aspect, the stem retainer 860 forms both the lower sloping surfaces 867 and the upper sloping surfaces 862 that interact with the actuator 805 to drive the stem retainer 860 both upward and downward.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A lid assembly, comprising:

a lid body comprising an indentation in the lid body and a dispensing opening passing through the lid body;

an actuator movably engaged to the indentation, and the actuator comprising a sloped lower surface and an inclined surface;

a valve assembly comprising a valve body featuring a valve stem, and the valve stem configured to pass through the lid body;

a stem retainer in a cavity of the lid body, wherein the stem retainer comprises a sloped upper surface and a second sloped lower surface, wherein the stem retainer engages with the valve stem; and, the sloped lower surface of the actuator is positioned over the sloped upper surface of the stem retainer, and the inclined surface of the actuator is positioned under the second sloped lower surface of the stem retainer.

2. The lid assembly according to claim 1, wherein the actuator is configured to move relative to the indentation to open and close the valve assembly, wherein the sloped lower surface of the actuator engages with the sloped upper surface of the stem retainer to drive the stem retainer downward.

3. The lid assembly according to claim 1, wherein the actuator is configured to move to open and close the dispensing opening and to also simultaneously open and close the valve assembly.

4. The lid assembly according to claim 1, wherein the actuator is configured to open and close the valve assembly.

5. The lid assembly according to claim 1, wherein the actuator is configured to move to an open position and to a closed position, wherein, in the open position, the actuator uncovers the dispensing opening and opens the valve assembly, and wherein, in the closed position, the actuator covers the dispensing opening and closes the valve assembly.

6. The lid assembly according to claim 1, wherein the valve body is biased upward by a biasing member to seal against a lower outer wall of the lid body.

7. The lid assembly according to claim 6, wherein a lower end of the lower outer wall of the lid body is formed with a generally contiguous surface having one or more breaks in the contiguous surface.

8. The lid assembly according to claim 6, wherein the actuator is configured to contact the stem retainer, overcome the bias of the biasing member, and urge the valve body downward.

9. A lid assembly, comprising:

a lid body comprising an indentation in the lid body and a dispensing opening passing through the lid body;

an actuator movably engaged to the indentation, and the actuator comprising a sloped lower surface;

a valve assembly comprising a valve body featuring a valve stem;

a stem retainer in a cavity of the lid body, wherein the stem retainer comprises a sloped upper surface, wherein the stem retainer engages with the valve stem; and, the sloped lower surface of the actuator is positioned over the sloped upper surface of the stem retainer, wherein a lower surface of the actuator defines a channel that receives an upper end of the valve stem, wherein the channel limits movement of the upper end of the valve stem.

10. The lid assembly according to claim 1, wherein the valve body comprises the valve stem extending generally perpendicular from a valve body plate, wherein the valve stem passes through a central passage of the lid body, and an upper end of the valve stem locks with the stem retainer.

11. The lid assembly according to claim 10, wherein valve stem passes through an interior of the biasing member, and the biasing member biases against a bottom surface of the cavity and a lower surface of the stem retainer in order to bias the valve body upward to close the valve assembly.

12. A lid assembly, comprising:

a lid body comprising an indentation in the lid body and a dispensing opening passing through the lid body;

an actuator movably engaged to the indentation, and the actuator comprising a sloped lower surface;

a valve assembly comprising a valve body featuring a valve stem;

a stem retainer in a cavity of the lid body, wherein the stem retainer comprises a sloped upper surface, wherein the stem retainer engages with the valve stem; and, the sloped lower surface of the actuator is positioned over the sloped upper surface of the stem retainer, wherein the valve body comprises the valve stem extending generally perpendicular from a valve body plate, wherein the valve body plate includes one or more ridges that extend upward from the valve body plate to meet with protrusions extending from an inner surface of a lower outer wall of the lid body to reduce any rotation of the valve body.

13. A lid assembly, comprising:

a lid body comprising an indentation in the lid body and a dispensing opening passing through the lid body;

an actuator movably engaged to the indentation, and the actuator comprising a sloped lower surface;

a valve assembly comprising a valve body featuring a valve stem;

a stem retainer in a cavity of the lid body, wherein the stem retainer comprises a sloped upper surface, wherein the stem retainer engages with the valve stem; and, the sloped lower surface of the actuator is positioned over the sloped upper surface of the stem retainer, wherein the indentation includes indentation sidewalls having protrusions, and wherein the actuator includes sidewalls having openings, which leads to channels, wherein the protrusions of the indentation sidewalls enter into the openings and the channels of the sidewalls to slidably lock the actuator to the lid body.

14. The lid assembly according to claim 13, wherein the protrusions or channels comprise ramps or inclines that prevent removal of the actuator from the indentation.

15. The lid assembly according to claim 1, wherein the actuator is selected from the group of a sliding member, a twisting member, a magnetic assembly, a lever member, or a button member.

16. A beverage container assembly comprising the lid assembly according to claim 1 and a beverage container, wherein the lid assembly is configured to engage to the beverage container.

17. A lid assembly, comprising:

a lid body comprising a dispensing opening passing through the lid body;

an actuator movably engaged to the lid body, and the actuator comprising a first sloped lower surface and an inclined surface;

a valve assembly comprising a valve body featuring a valve stem, and the valve stem configured to pass through the lid body;

a stem retainer in the lid body, wherein the stem retainer comprises a sloped upper surface and a second sloped lower surface, wherein the stem retainer engages with the valve stem;

the first sloped lower surface of the actuator is positioned over the sloped upper surface of the stem retainer; and, the inclined surface of the actuator is positioned under the second sloped lower surface of the stem retainer.

18. The lid assembly according to claim 17, wherein, during an opening movement of the actuator, the first sloped lower surface of the actuator slides against the sloped upper surface to drive the valve assembly to an open position, and, wherein, during a closing movement of the actuator, the inclined surface of the actuator slides against the second sloped lower surface to drive the valve assembly to a closed position.

19. The lid assembly according to claim 17, wherein a lever is engaged to the actuator, wherein the lever releasably holds the actuator to the lid body, wherein the lever is movable to release the actuator from the lid body.

20. The lid assembly according to claim 17, wherein, an opening movement of the actuator drives the first sloped lower surface of the actuator against the sloped upper surface of the stem retainer to drive the valve body downward.

21. A The lid assembly according to claim 17, wherein the valve body configured to seal a lower opening of the lid body;

the actuator slides with respect to the lid body to an open position to uncover the dispensing opening and to drive the valve stem to move the valve body to an open valve position with respect to the lower opening; and the actuator slides with respect to the lid body to a closed position to cover the dispensing opening and to drive the valve stem to move the valve body to a closed valve position with respect to the lower opening.

* * * * *